US008701422B2

(12) United States Patent
Bell et al.

(10) Patent No.: US 8,701,422 B2
(45) Date of Patent: Apr. 22, 2014

(54) THERMOELECTRIC HEAT PUMP

(75) Inventors: Lon E. Bell, Altadena, CA (US); Robert W. Diller, Pasadena, CA (US)

(73) Assignee: BSST LLC, Azusa, CA (US)

( * ) Notice: Subject to any disclaimer, the term of this patent is extended or adjusted under 35 U.S.C. 154(b) by 1066 days.

(21) Appl. No.: 12/477,806

(22) Filed: Jun. 3, 2009

(65) Prior Publication Data

US 2009/0293499 A1 Dec. 3, 2009

Related U.S. Application Data

(60) Provisional application No. 61/058,482, filed on Jun. 3, 2008, provisional application No. 61/087,611, filed on Aug. 8, 2008.

(51) Int. Cl.
*F25B 21/02* (2006.01)

(52) U.S. Cl.
USPC ..... 62/3.3; 62/3.2; 62/3.7

(58) Field of Classification Search
USPC ..... 62/3.2, 3.3, 3.7, 3.62; 165/135
See application file for complete search history.

(56) References Cited

U.S. PATENT DOCUMENTS

| | | | |
|---|---|---|---|
| 1,120,781 | A | 12/1914 | Altenkirch et al. |
| 2,027,534 | A | 1/1936 | Ingersoll |
| 2,944,404 | A | 7/1960 | Fritts |
| 2,949,014 | A | 8/1960 | Belton, Jr. et al. |
| 2,992,538 | A | 7/1961 | Siegfried |
| 3,004,393 | A | 10/1961 | Alsing |
| 3,006,979 | A | 10/1961 | Rich |
| 3,019,609 | A | 2/1962 | Pietsch |
| 3,071,495 | A | 1/1963 | Hänlein |
| 3,085,405 | A | 4/1963 | Frantti |
| 3,125,860 | A | 3/1964 | Reich |
| 3,126,116 | A | 3/1964 | Clinehens |
| 3,129,116 | A | 4/1964 | Corry |
| 3,137,142 | A | 6/1964 | Venema |
| 3,138,934 | A | 6/1964 | Roane |

(Continued)

FOREIGN PATENT DOCUMENTS

| | | | |
|---|---|---|---|
| CN | 1249067 | A | 3/2000 |
| DE | 4329816 | | 10/1994 |

(Continued)

OTHER PUBLICATIONS

Angrist, Stanley W., *Direct Energy Conversion*, 32, Ed. Ally & Bacon (1976).

(Continued)

*Primary Examiner* — Cassy D Bauer
(74) *Attorney, Agent, or Firm* — Knobbe, Martens, Olson & Bear, LLP

(57) ABSTRACT

In certain embodiments, a thermoelectric heat pump includes a heat transfer region having an array of thermoelectric modules, a waste channel in substantial thermal communication with a high temperature portion of the heat transfer region, and a main channel in substantial thermal communication with a low temperature portion of the heat transfer region. An enclosure wall provides a barrier between fluid in the waste channel and fluid in the main channel throughout the interior of the thermoelectric heat pump. In some embodiments, the waste fluid channel and the main fluid channel are positioned and shaped such that differences in temperature between fluids disposed near opposite sides of the enclosure wall are substantially decreased or minimized at corresponding positions along the channels.

22 Claims, 33 Drawing Sheets

(56) References Cited

U.S. PATENT DOCUMENTS 3,178,895 A 4/1965 Mole et al.
3,197,342 A 7/1965 Neild, Jr.
3,212,275 A 10/1965 Tillman, Jr.
3,213,630 A 10/1965 Mole
3,391,727 A 7/1968 Topouszian
3,505,728 A 4/1970 Hare et al.
3,522,106 A 7/1970 Debiesse et al.
3,527,621 A 9/1970 Newton
3,554,815 A 1/1971 Osborn
3,599,437 A 8/1971 Panas
3,607,444 A 9/1971 DeBucs
3,626,704 A 12/1971 Coe, Jr.
3,635,037 A 1/1972 Hubert
3,663,307 A 5/1972 Mole
3,681,929 A 8/1972 Schering
3,726,100 A 4/1973 Widakowich
3,779,814 A 12/1973 Miles et al.
3,817,043 A 6/1974 Zoleta
3,885,126 A 5/1975 Sugiyama et al.
3,958,324 A 5/1976 Alais et al.
4,038,831 A 8/1977 Gaudel et al.
4,047,093 A 9/1977 Levoy
4,055,053 A 10/1977 Elfving
4,056,406 A 11/1977 Markman et al.
4,065,936 A 1/1978 Fenton et al.
4,125,122 A 11/1978 Stachurski
4,281,516 A 8/1981 Berthet et al.
4,297,841 A 11/1981 Cheng
4,297,849 A 11/1981 Buffet
4,402,188 A 9/1983 Skala
4,420,940 A 12/1983 Buffet
4,448,028 A 5/1984 Chao et al.
4,494,380 A 1/1985 Cross
4,499,329 A 2/1985 Benicourt et al.
4,595,297 A 6/1986 Liu et al.
4,634,803 A 1/1987 Mathiprakasam
4,730,459 A 3/1988 Schlicklin et al.
4,731,338 A 3/1988 Ralston et al.
4,802,929 A 2/1989 Schock
4,823,554 A 4/1989 Trachtenberg et al.
4,905,475 A 3/1990 Tuomi
4,907,060 A 3/1990 Nelson et al.
4,989,626 A 2/1991 Takagi et al.
5,006,178 A 4/1991 Bijvoets
5,038,569 A 8/1991 Shirota et al.
5,092,129 A 3/1992 Bayes et al.
5,097,829 A 3/1992 Quisenberry
5,171,372 A 12/1992 Recine, Sr.
5,180,293 A 1/1993 Hartl
5,193,347 A 3/1993 Apisdorf
5,228,923 A 7/1993 Hed
5,232,516 A 8/1993 Hed
5,254,178 A 10/1993 Yamada et al.
5,316,078 A 5/1994 Cesaroni
5,385,020 A 1/1995 Gwilliam et al.
5,419,780 A 5/1995 Suski
5,429,680 A 7/1995 Fuschetti
5,430,322 A 7/1995 Koyanagi et al.
5,431,021 A 7/1995 Gwilliam et al.
5,456,081 A 10/1995 Chrysler et al.
5,499,504 A 3/1996 Mill et al.
5,544,487 A 8/1996 Attey et al.
5,549,153 A 8/1996 Wilhelm et al.
5,561,981 A 10/1996 Quisenberry et al.
5,576,512 A 11/1996 Doke
5,584,183 A 12/1996 Wright et al.
5,592,363 A 1/1997 Atarashi et al.
5,594,609 A 1/1997 Lin
5,605,047 A 2/1997 Park et al.
5,653,111 A 8/1997 Attey et al.
5,682,748 A 11/1997 DeVilbiss et al.
5,705,770 A 1/1998 Ogassawara et al.
5,724,818 A 3/1998 Iwata et al.
5,802,856 A 9/1998 Schaper et al.
5,822,993 A 10/1998 Attey
5,860,472 A 1/1999 Batchelder
5,867,990 A 2/1999 Ghoshal
5,900,071 A 5/1999 Harman
RE36,242 E 6/1999 Apisdorf
5,921,088 A 7/1999 Imaizumi et al.
5,959,341 A 9/1999 Tsuno et al.
5,966,941 A 10/1999 Ghoshal
5,975,856 A 11/1999 Welle
5,987,890 A 11/1999 Chiu et al.
6,000,225 A 12/1999 Ghoshal
6,028,263 A 2/2000 Kobayashi et al.
6,050,326 A 4/2000 Evans
6,082,445 A 7/2000 Dugan
6,084,172 A 7/2000 Kishi et al.
6,096,966 A 8/2000 Nishimoto et al.
6,127,766 A 10/2000 Roidt
6,213,198 B1 4/2001 Shikata et al.
6,223,539 B1 5/2001 Bell
6,270,015 B1 8/2001 Hirota
6,282,907 B1 9/2001 Ghoshal
6,302,196 B1 10/2001 Haussmann
6,319,744 B1 11/2001 Hoon et al.
6,320,280 B1 11/2001 Kanesaka
6,334,311 B1 1/2002 Kim et al.
6,346,668 B1 2/2002 McGrew
6,347,521 B1 2/2002 Kadotani et al.
6,357,518 B1 * 3/2002 Sugimoto et al. ..... 165/140
6,359,725 B1 3/2002 Islam
6,366,832 B2 4/2002 Lomonaco et al.
6,367,261 B1 4/2002 Marshall et al.
6,385,976 B1 5/2002 Yamamura et al.
6,393,842 B2 5/2002 Kim
6,401,462 B1 6/2002 Bielinski
6,412,287 B1 7/2002 Hughes et al.
6,446,442 B1 9/2002 Batchelor et al.
6,474,073 B1 11/2002 Uetsuji et al.
6,477,844 B2 11/2002 Ohkubo et al.
6,481,213 B2 11/2002 Carr et al.
6,499,306 B2 12/2002 Gillen
6,510,696 B2 1/2003 Guttman et al.
6,530,231 B1 3/2003 Nagy et al.
6,530,842 B1 3/2003 Wells et al.
6,539,725 B2 4/2003 Bell
6,541,139 B1 4/2003 Cibuzar
6,548,750 B1 4/2003 Picone
6,560,968 B2 5/2003 Ko
6,563,039 B2 5/2003 Caillat et al.
RE38,128 E 6/2003 Gallup et al.
6,580,025 B2 6/2003 Guy
6,598,403 B1 7/2003 Ghoshal
6,598,405 B2 7/2003 Bell
6,606,866 B2 8/2003 Bell
6,625,990 B2 9/2003 Bell
6,637,210 B2 10/2003 Bell
6,672,076 B2 1/2004 Bell
6,700,052 B2 3/2004 Bell
6,705,089 B2 3/2004 Chu et al.
6,779,348 B2 8/2004 Taban
6,812,395 B2 11/2004 Bell
6,880,346 B1 4/2005 Tseng et al.
6,907,739 B2 6/2005 Bell
6,948,321 B2 9/2005 Bell
6,959,555 B2 11/2005 Bell
6,973,799 B2 12/2005 Kuehl et al.
7,100,369 B2 9/2006 Yamaguchi et al.
7,111,465 B2 9/2006 Bell
7,134,288 B2 11/2006 Crippen et al.
7,231,772 B2 6/2007 Bell
7,235,735 B2 6/2007 Venkatasubramanian et al.
7,421,845 B2 9/2008 Bell
7,587,902 B2 9/2009 Bell
7,870,745 B2 1/2011 Goenka
7,926,293 B2 4/2011 Bell
7,932,460 B2 4/2011 Bell
8,069,674 B2 12/2011 Bell
8,079,223 B2 12/2011 Bell
2001/0029974 A1 10/2001 Cohen et al.
2002/0014261 A1 2/2002 Caillat et al.
2002/0079770 A1 6/2002 Lai et al.

(56) References Cited

U.S. PATENT DOCUMENTS

| | | | |
|---|---|---|---|
| 2002/0139123 | A1 | 10/2002 | Bell |
| 2002/0148234 | A1 | 10/2002 | Bell |
| 2003/0005706 | A1 | 1/2003 | Bell |
| 2003/0029173 | A1* | 2/2003 | Bell et al. ..... 62/3.3 |
| 2003/0029175 | A1 | 2/2003 | Lee |
| 2003/0084935 | A1 | 5/2003 | Bell |
| 2003/0094265 | A1 | 5/2003 | Chu et al. |
| 2003/0106677 | A1* | 6/2003 | Memory et al. ..... 165/135 |
| 2003/0140636 | A1 | 7/2003 | Van Winkle |
| 2003/0217738 | A1 | 11/2003 | Ryon |
| 2004/0025516 | A1 | 2/2004 | Van Winkle |
| 2004/0076214 | A1 | 4/2004 | Bell |
| 2004/0089336 | A1 | 5/2004 | Hunt |
| 2004/0177876 | A1 | 9/2004 | Hightower |
| 2004/0261829 | A1 | 12/2004 | Bell |
| 2005/0072165 | A1 | 4/2005 | Bell |
| 2005/0081834 | A1 | 4/2005 | Perkins |
| 2005/0121065 | A1 | 6/2005 | Otey |
| 2005/0139692 | A1 | 6/2005 | Yamamoto |
| 2005/0247336 | A1 | 11/2005 | Inaoka |
| 2005/0263177 | A1 | 12/2005 | Bell |
| 2005/0279105 | A1 | 12/2005 | Pastorino |
| 2006/0005548 | A1 | 1/2006 | Ruckstuhl |
| 2006/0080979 | A1 | 4/2006 | Kitanovski et al. |
| 2006/0086118 | A1 | 4/2006 | Venkatasubramanian et al. |
| 2006/0168969 | A1 | 8/2006 | Mei et al. |
| 2006/0174633 | A1 | 8/2006 | Beckley |
| 2006/0219281 | A1 | 10/2006 | Kuroyanagi et al. |
| 2006/0254284 | A1 | 11/2006 | Ito et al. |
| 2007/0000255 | A1 | 1/2007 | Elliot et al. |
| 2007/0125413 | A1 | 6/2007 | Olsen et al. |
| 2007/0220902 | A1 | 9/2007 | Matsuoka et al. |
| 2007/0272290 | A1 | 11/2007 | Sims et al. |
| 2008/0028769 | A1 | 2/2008 | Goenka |
| 2008/0173342 | A1 | 7/2008 | Bell et al. |
| 2008/0245398 | A1 | 10/2008 | Bell et al. |
| 2008/0289677 | A1 | 11/2008 | Bell et al. |
| 2009/0000310 | A1 | 1/2009 | Bell et al. |
| 2009/0007572 | A1 | 1/2009 | Bell |
| 2009/0007952 | A1 | 1/2009 | Kondoh et al. |
| 2009/0133734 | A1 | 5/2009 | Takahashi et al. |
| 2009/0301103 | A1 | 12/2009 | Bell et al. |
| 2010/0031987 | A1 | 2/2010 | Bell |
| 2010/0031988 | A1 | 2/2010 | Bell |
| 2010/0052374 | A1 | 3/2010 | Bell et al. |
| 2010/0101238 | A1 | 4/2010 | LaGrandeur et al. |
| 2010/0101239 | A1 | 4/2010 | LaGrandeur et al. |
| 2010/0326092 | A1 | 12/2010 | Goenka |
| 2010/0331657 | A1 | 12/2010 | Mensinger et al. |
| 2011/0067742 | A1 | 3/2011 | Bell et al. |
| 2011/0107772 | A1 | 5/2011 | Goenka |
| 2011/0162389 | A1 | 7/2011 | Bell |
| 2011/0209740 | A1 | 9/2011 | Bell et al. |
| 2011/0247668 | A1 | 10/2011 | Bell et al. |
| 2011/0258995 | A1 | 10/2011 | Limbeck et al. |
| 2012/0102934 | A1 | 5/2012 | Magnetto |
| 2012/0111386 | A1 | 5/2012 | Bell et al. |
| 2012/0174567 | A1 | 7/2012 | Limbeck et al. |
| 2012/0177864 | A1 | 7/2012 | Limbeck et al. |
| 2012/0266608 | A1 | 10/2012 | Kadle et al. |
| 2013/0037073 | A1 | 2/2013 | LaGrandeur |
| 2013/0068273 | A1 | 3/2013 | Kanno et al. |
| 2013/0104953 | A1 | 5/2013 | Poliquin et al. |
| 2013/0160809 | A1 | 6/2013 | Mueller |
| 2013/0167894 | A1 | 7/2013 | Brueck et al. |

FOREIGN PATENT DOCUMENTS

| | | | |
|---|---|---|---|
| EP | 0272937 | | 6/1988 |
| EP | 1 174 996 | A1 | 1/2002 |
| EP | 1 324 400 | A | 7/2003 |
| EP | 1 475 532 | A | 11/2004 |
| EP | 1 515 376 | | 3/2005 |
| EP | 2 541 634 | A1 | 1/2013 |
| EP | 1 780 807 | A1 | 2/2013 |
| FR | 1 280 711 | A | 1/1962 |
| FR | 2 419 479 | A | 10/1979 |
| FR | 2 543275 | | 9/1984 |
| FR | 2543275 | | 9/1984 |
| FR | 2 550 324 | A | 2/1985 |
| FR | 2806666 | | 9/2001 |
| FR | 2 879 728 | | 6/2006 |
| GB | 231 192 | A | 5/1926 |
| GB | 817077 | | 7/1959 |
| GB | 952 678 | | 3/1964 |
| GB | 1151947 | | 5/1969 |
| GB | 2027534 | | 2/1980 |
| GB | 2267338 | | 1/1993 |
| GB | 2 333 352 | | 7/1999 |
| JP | 56-18231 | | 2/1981 |
| JP | 59097457 | | 6/1984 |
| JP | 60-80044 | | 7/1985 |
| JP | 63-262076 | A | 10/1988 |
| JP | 01 131830 | A | 5/1989 |
| JP | 01 200122 | | 8/1989 |
| JP | 03-263382 | | 11/1991 |
| JP | 4-165234 | | 6/1992 |
| JP | 5-219765 | | 8/1993 |
| JP | 06-089955 | | 3/1994 |
| JP | 06-342940 | | 12/1994 |
| JP | 7-198284 | | 1/1995 |
| JP | A-7-7187 | | 1/1995 |
| JP | 07-074397 | | 3/1995 |
| JP | 09-321355 | | 5/1995 |
| JP | A-7-202275 | | 8/1995 |
| JP | 07253264 | | 10/1995 |
| JP | 08-222771 | | 8/1996 |
| JP | A-8-293627 | | 11/1996 |
| JP | 09042801 | | 2/1997 |
| JP | 9-089284 | A | 4/1997 |
| JP | 9276076 | | 10/1997 |
| JP | 10012935 | | 1/1998 |
| JP | 10035268 | | 2/1998 |
| JP | H10-325561 | | 8/1998 |
| JP | 10238406 | A | 9/1998 |
| JP | 10-275943 | | 10/1998 |
| JP | 10290590 | | 10/1998 |
| JP | 11-317481 | | 11/1998 |
| JP | 11-032492 | | 2/1999 |
| JP | 11 046021 | | 2/1999 |
| JP | 11046021 | | 2/1999 |
| JP | 11-182907 | | 7/1999 |
| JP | 11-201475 | A | 7/1999 |
| JP | 11-274574 | | 10/1999 |
| JP | 2000 018095 | | 1/2000 |
| JP | H2000-58930 | | 2/2000 |
| JP | 00 208823 | | 7/2000 |
| JP | H2000-214934 | | 8/2000 |
| JP | 2000-274788 | | 10/2000 |
| JP | 2000-274874 | | 10/2000 |
| JP | 01 007263 | A | 1/2001 |
| JP | 2001-24240 | | 1/2001 |
| JP | 2001-210879 | | 8/2001 |
| JP | 2001-267642 | A | 9/2001 |
| JP | 2001304778 | | 10/2001 |
| JP | 2001-336853 | | 1/2002 |
| JP | 2002-13758 | | 1/2002 |
| JP | 2002059736 | A | 2/2002 |
| JP | 2002 232028 | A | 8/2002 |
| JP | 2003 259671 | | 9/2003 |
| JP | 03 332642 | | 11/2003 |
| JP | 2003 332642 | | 11/2003 |
| JP | 04 079883 | | 3/2004 |
| JP | 2004 079883 | | 3/2004 |
| JP | 2004-360522 | | 12/2004 |
| JP | 2005-212564 | | 8/2005 |
| JP | 2005 317648 | | 11/2005 |
| JP | 2008 274790 | | 11/2008 |
| JP | 2008300465 | | 12/2008 |
| JP | 2009-010138 | A | 1/2009 |
| JP | 2009 033806 | | 2/2009 |
| JP | 10 2010 012 629 | | 9/2011 |
| LU | 66619 | | 2/1973 |

(56) References Cited

FOREIGN PATENT DOCUMENTS

| | | | |
|---|---|---|---|
| RU | 2142178 | | 11/1999 |
| RU | 2 154 875 | C2 | 8/2000 |
| SE | 329 870 | | 10/1970 |
| SE | 337 227 | | 5/1971 |
| SU | 184886 | A | 7/1966 |
| SU | 1142711 | A | 2/1985 |
| WO | WO 97/22486 | A1 | 6/1997 |
| WO | WO 97/47930 | | 12/1997 |
| WO | WO 98/56047 | A1 | 12/1998 |
| WO | WO 99/10191 | | 3/1999 |
| WO | WO 02/03659 | | 1/2002 |
| WO | WO 02/03772 | | 1/2002 |
| WO | WO 02/25233 | | 3/2002 |
| WO | WO 02/065030 | | 8/2002 |
| WO | WO 02/081982 | | 10/2002 |
| WO | WO 03/017834 | | 3/2003 |
| WO | WO 03/024899 | | 3/2003 |
| WO | WO 03/074951 | A1 | 9/2003 |
| WO | WO 03/090286 | A | 10/2003 |
| WO | WO 03/104726 | A1 | 12/2003 |
| WO | WO 2004/019379 | A | 3/2004 |
| WO | WO 2004/026560 | | 4/2004 |
| WO | WO 2004/026757 | | 4/2004 |
| WO | WO 2005/023571 | | 3/2005 |
| WO | WO 2005/020340 | A | 5/2005 |
| WO | WO 2005/098225 | A | 10/2005 |
| WO | WO 2006/001827 | | 1/2006 |
| WO | WO 2006/037178 | A | 4/2006 |
| WO | WO 2006/043514 | A | 4/2006 |
| WO | WO 2006/064432 | | 6/2006 |
| WO | WO 2007/001289 | | 1/2007 |
| WO | WO 2007/109368 | | 9/2007 |
| WO | WO 2008/013946 | A2 | 1/2008 |
| WO | WO 2008/042077 | | 4/2008 |
| WO | WO 2008/091293 | A2 | 7/2008 |
| WO | WO 2012/031980 | A3 | 3/2012 |
| WO | WO 2012/045542 | A3 | 4/2012 |

OTHER PUBLICATIONS

Bell, L.E., "Use of Thermal Isolation to Improve Thermoelectric System Operating Efficiency," Proc. 21st Int'l Conf. on Thermoelectrics, Long Beach, CA (Aug. 2002).

Bell, L.E., "Increased Thermoelectric System Thermodynamic Efficiency by Use of Convective Heat Transport," Proc. 21st Int'l Conf. on Thermoelectrics, Long Beach, CA (Aug. 2002).

R.J. Buist, J.W. Fenton and J.S. Lee, *A New Concept for Improving Thermoelectric Heat Pump Efficiency*, Borg-Warner Thermoelectrics Wolf and Algonquin Road.

R. Buist and P. Lau, *Theoretical Analysis of Thermoelectric Cooling Performance Enhancement Via Thermal and Electrical Pulsing*, Journal of Thermoelectricity, No. 4, 1996.

Diller, R.W., et al., "Experimental Results Confirming Improved Efficiency of Thermoelectric Power Generation Systems and Alternate Thermodynamic Cycles," 22nd International Conference on Thermoelectrics, 2003, pp. 571-573.

Goldsmid, H.J., *Electronic Refrigeration*, Pion Ltd., 207 Brondesbury Park, London (1986).

Ikoma, K., et al., "Thermoelectric Module and Generator for Gasoline Engine Vehicles," 17th Int'l Conf. on Thermo-electrics, Nagoya, Japan, pp. 464-467 (1998).

Miner, A. Majumdar, A., and U. Ghoshal, *Thermo-Electro-Mechanical Refrigeration Based on Transient Thermoelectric Effects*, Applied Physics letters, vol. 75, pp. 1176-1178 (1999).

*CRC Handbook of Thermoelectrics*, ed. D.M. Rowe, Chapter 54, *Medium-Scale Cooling: Thermoelectric Module Technology*, Jul. 1995, ISBN: 0-8493-0146-7.

Shigeru Tada, , et al, *A New Concept of Porous Thermoelectric Module Using a Reciprocating Flow for Cooling/Heating System* (*Numerical Analysis for Heating System*), 16th International Conference on Thermoelectrics (1997).

International Search Report with Written Opinion dated Mar. 17, 2010, Application No. PCT/US2009/046166, filed Jun. 3, 2009.

International Search Report dated Feb. 12, 2009, Application No. PCT/US/2009/046166, filed Mar. 6, 2009.

Derwent-Acc-No. 1998-283540, Kwon, H et al., Hyundai Motor Co., corresponding to KR 97026106 A, published Jun. 24, 1997 (2 pages).

Diller, R. W., et al.: "Experimental results confirming improved performance of systems using thermal isolation" Thermoelectrics, 2002. Proceedings ICT '02. Twenty-First International Conference on Aug. 25-29, 2002, Piscataway, NJ USA, IEEE, Aug. 25, 2002, pp. 548-550, XP010637541 ISBN: 0-7803-7683-8.

Hendricks, Terry et al., "Advanced Thermoelectric Power System Investigations for Light-Duty and Heavy Duty Applications," National Renewable Energy Laboratory, Center for Transportation Technology & Systems, Colorado, 2002.

International Preliminary Report on Patentability dated Dec. 16, 2010, Application No. PCT/US2009/046166 filed Jun. 3, 2009.

Lofy, John et al., "Thermoelectrics for Environmental Control Automobiles, 21st International Conference on Thermoelectronics," 2002, p. 471-476.

Menchen, William R., et al., "Thermoelectric Conversion to Recover Heavy Duty Diesel Exhaust Energy," Teledyne Energy Systems, Timonium, MD 1990.

Snyder, G. Jeffrey, et al., "Thermoelectric Effciency and Compatibility," The American Physical Society, Oct. 2, 2003, vol. 91, No. 14.

Tada, S., et al., "A New Concept of Porous Thermoelectric Module Using a Reciprocating Flow for Cooling/Heating Systems (Numerical Analysis for Heating Systems)" 16th International Conference on Thermoelectrics (1977).

Office Action dated Sep. 21, 2012, U.S. Appl. No. 12/477,812.

Funahashi et al., "Preparation and properties of thermoelectric pipe-type modules", ICT 25th International Conference on Aug. 6-10, 2006, Thermoelectrics, 2006, pp. 58-61.

Min et al., "Ring-structured thermoelectric module", Semiconductor Science and Technology, Aug. 2007, vol. 22, No. 8, pp. 880-888.

Thermoelectrics Handbook: Macro to Nano, 2006, Chpt. 11, Section 11.7, pp. 11-11 to 11-15, CRC Press, Boca Raton, FL.

* cited by examiner

THERMOELECTRIC HEAT PUMP

RELATED APPLICATIONS

This application claims the benefit under 35 U.S.C. §119 (e) of U.S. Provisional Patent Application No. 61/058,482, titled "Thermoelectric Device Enclosures with Improved Fluid Channeling," filed Jun. 3, 2008, and U.S. Provisional Patent Application No. 61/087,611, titled "Improved Thermoelectric Device Enclosures," filed Aug. 8, 2008. This application is related to U.S. application Ser. No. 12/477,812, concurrently filed with this application. The entire contents of each of the above-identified applications are incorporated by reference herein and made a part of this specification.

BACKGROUND

1. Field

This disclosure relates to the field of thermoelectric devices and, in particular, to improved thermoelectric device enclosures and assemblies.

2. Description of Related Art

Certain thermoelectric (TE) devices, sometimes called Seebeck-Peltier devices, Peltier devices, thermoelectric engines, thermoelectric heat exchangers or thermoelectric heat pumps, employ the Peltier effect to transfer heat against the temperature gradient when an electric voltage is applied across certain types of materials, sometimes called thermoelectric materials or compounds. Examples of TE materials include, for example, doped PbTe, $Bi_2Te_3$, and other materials with a relatively high Seebeck coefficient. The Seebeck coefficient is a value that relates a temperature difference across a region of material with a corresponding electric potential difference across the region of material.

The efficiency of at least some TE devices can be improved by removing thermal energy from areas of a device where thermal energy accumulates due to, for example, the Peltier effect. Removal of such thermal energy can be accomplished, for example, by moving a waste fluid flow, such as air, across high temperature portions of TE materials or heat transfer structures attached to said high temperature portions. Furthermore, TE devices sometimes move a main fluid flow across low temperature portions of TE materials or heat transfer structures attached to said low temperature portions to remove heat from the main fluid flow. The main fluid flow may be used, for example, to cool enclosed spaces, materials, or equipment.

TE devices are typically housed in an enclosure that routes the fluid flows across a heat exchanger operatively coupled to the TE materials. Existing TE device enclosures and assemblies suffer from various drawbacks.

SUMMARY

Certain embodiments provide an assembly for a thermoelectric heat pump including: an enclosure with a plurality of substantially thermally isolated fluid channels formed therein; a first thermoelectric module operatively connected to the enclosure, the first thermoelectric module including a main junction and a waste junction; an elongate heat transfer member extending from at least one of the main junction and the waste junction of the first thermoelectric module into at least one of the plurality of fluid channels; at least one gap dividing the elongate heat transfer member into a plurality of heat transfer sections that are at least partially thermally isolated from adjacent heat transfer sections by the at least one gap, the at least one gap oriented such that fluid flows across the at least one gap as fluid flows through a fluid channel of the thermoelectric heat pump; and at least one bridge member extending across the at least one gap, the at least one bridge member connecting at least one of the plurality of heat transfer sections to a second heat transfer section.

The assembly can further include a second thermoelectric module operatively connected to the enclosure, the second thermoelectric module having a second main junction and a second waste junction. The first thermoelectric module and the second thermoelectric module can be arranged in substantially parallel planes, and the first and second thermoelectric modules can be oriented such that the waste junction of the first thermoelectric module and the second waste junction of the second thermoelectric module face towards one another. The elongate heat transfer member can extend from the waste junction of the first thermoelectric module to the second waste junction of the second thermoelectric module. Alternatively, the elongate heat transfer member can extend about half the distance from the waste junction of the first thermoelectric module to the second waste junction of the second thermoelectric module.

In some embodiments, the at least one bridge member is formed by removing portions of an elongate heat transfer member. The assembly can further include at least a second bridge member connecting the second heat transfer section to a third heat transfer section, wherein the at least one bridge member and the second bridge member are disposed at staggered positions along the at least one gap.

The assembly can have a heat transfer region including a plurality of rows, each of the plurality of rows including a plurality of thermoelectric modules. The plurality of fluid channels can include a waste fluid channel configured to be in substantial thermal communication with a high temperature portion of the heat transfer region and a main fluid channel configured to be in substantial thermal communication with a low temperature portion of the heat transfer region. A channel enclosure can provide a barrier between fluid in the waste fluid channel and fluid in the main fluid channel. The waste fluid channel and the main fluid channel can be positioned and shaped such that differences in temperature between fluids disposed near opposite sides of the channel enclosure are substantially minimized at corresponding positions along the channels.

Some additional embodiments provide a method of manufacturing a thermoelectric heat pump. The method can include providing an enclosure with a plurality of substantially thermally isolated fluid channels formed therein; operatively connecting a first thermoelectric module to the enclosure, the first thermoelectric module including a main junction and a waste junction; disposing an elongate heat transfer member within the enclosure, the elongate heat transfer member extending from at least one of the main junction and the waste junction of the first thermoelectric module into at least one of the plurality of fluid channels; providing at least one gap in the elongate heat transfer member, the at least one gap dividing the elongate heat transfer member into a plurality of heat transfer sections that are at least partially thermally isolated from adjacent heat transfer sections by the at least one gap, the at least one gap oriented such that fluid flows across the at least one gap as fluid flows through a fluid channel of the thermoelectric heat pump; and disposing at least one bridge member across the at least one gap, the at least one bridge member connecting at least one of the plurality of heat transfer sections to a second heat transfer section.

The method can further include operatively connecting a second thermoelectric module operatively connected to the enclosure, the second thermoelectric module having a second main junction and a second waste junction. In certain embodiments, the method includes arranging the first thermoelectric module and the second thermoelectric module in substantially parallel planes and orienting the first and second thermoelectric modules such that the waste junction of the first thermoelectric module and the second waste junction of the second thermoelectric module face towards one another. The method can also include disposing the elongate heat transfer member between the waste junction of the first thermoelectric module and the second waste junction of the second thermoelectric module. In some embodiments, the elongate heat transfer member is disposed such that the elongate heat transfer member extends about half the distance from the waste junction of the first thermoelectric module to the second waste junction of the second thermoelectric module.

The method can include forming the at least one bridge member by removing portions of the elongate heat transfer member. The at least one bridge member can join a plurality of separate heat transfer sections to form an elongate heat transfer member.

In certain embodiments, the method includes disposing at least a second bridge member between the second heat transfer section and a third heat transfer section. The at least one bridge member and the second bridge member can be disposed at staggered positions along the at least one gap.

Certain further embodiments provide a method of operating a thermoelectric heat pump. The method can include directing a fluid stream into at least one of a plurality of substantially thermally isolated fluid channels formed in an enclosure; directing the fluid stream toward a first thermoelectric module operatively connected to the enclosure, the first thermoelectric module including a main junction and a waste junction; directing the fluid stream across an elongate heat transfer member extending from at least one of the main junction and the waste junction of the first thermoelectric module into the at least one of the plurality of fluid channels; and directing the fluid stream across at least one gap dividing the elongate heat transfer member into a plurality of heat transfer sections that are at least partially thermally isolated from adjacent heat transfer sections by the at least one gap. At least one bridge member can be disposed across the at least one gap, the at least one bridge member connecting at least one of the plurality of heat transfer sections to a second heat transfer section.

Some embodiments provide an assembly for a thermoelectric heat pump including a heat transfer region including a plurality of rows, each of the plurality of rows including a plurality of thermoelectric modules, each of the thermoelectric modules including a high temperature junction and a low temperature junction; a waste fluid channel configured to be in substantial thermal communication with a high temperature portion of the heat transfer region; a main fluid channel configured to be in substantial thermal communication with a low temperature portion of the heat transfer region; and a channel enclosure providing a barrier between fluid in the waste fluid channel and fluid in the main fluid channel.

The waste fluid channel and the main fluid channel can be positioned and shaped such that differences in temperature between fluids disposed near opposite sides of the channel enclosure are substantially minimized at corresponding positions along the channels. The high temperature portion of the heat transfer region can include a first heat exchanger operatively connected to at least one high temperature junction of the plurality of thermoelectric modules. The first heat exchanger can include at least one gap dividing the heat exchanger into a plurality of heat transfer sections that are at least partially thermally isolated from adjacent heat transfer sections by the at least one gap, the at least one gap oriented such that fluid flows across the at least one gap as fluid flows through the waste fluid channel of the thermoelectric heat pump; and at least one bridge member extending across the at least one gap, the at least one bridge member connecting at least one of the plurality of heat transfer sections to a second heat transfer section.

The low temperature portion of the heat transfer region can include a second heat exchanger operatively connected to at least one low temperature junction of the plurality of thermoelectric modules. Thermal interface material can be disposed between the heat conducting fins and junctions of the plurality of thermoelectric modules. The first heat exchanger can include an arrangement of fins spaced at regular intervals. The arrangement of fins in the first heat exchanger can provide a different heat transfer capability than the second heat exchanger. The first heat exchanger can include at least one heat conducting fin that has a thickness greater than the thickness of heat conducting fins of the second heat exchanger.

The first heat exchanger can include at least one overhanging portion that protrudes past the at least one high temperature junction and the second heat exchanger includes at least one overhanging portion that protrudes past the at least one low temperature junction. The channel enclosure can include projections configured to nestle between the overhanging portions of the first heat exchanger and the overhanging portions of the second heat exchanger, the projections configured to contact the heat transfer region at boundaries between high temperature portions of the heat transfer region and low temperature portions of the heat transfer region such that leakage between the waste fluid channel and the main fluid channel at the junction between the channel enclosure and the heat transfer region is substantially minimized.

The channel enclosure can be constructed from a material system having at least a portion with a thermal conductivity not greater than approximately 0.1 W/(m×K). At least a portion of the material can include a foamed material, a composite structure, or a copolymer of polystyrene and polyphenylene oxide.

At least some portions of the channel enclosure adjacent to the heat transfer region can be bonded to the heat transfer region in substantially airtight engagement. A material selected from the group consisting of an adhesive, a sealant, a caulking agent, a gasket material, or a gel can be disposed between the channel enclosure and portions of the heat transfer region contacted by the channel enclosure. The material can include at least one of silicone or urethane.

The channel enclosure can include projections configured to contact the heat transfer region at boundaries between the high temperature portion of the heat transfer region and the low temperature portion of the heat transfer region such that leakage between the waste fluid channel and the main fluid channel at the junction between the channel enclosure and the heat transfer region is substantially minimized.

The assembly can include a first fan operatively connected to provide fluid flow in the waste fluid channel. A second fan can be operatively connected to provide fluid flow in the main fluid channel in a direction opposite the fluid flow in the waste channel.

A first row of thermoelectric modules can be electrically connected in parallel. A second row of thermoelectric modules can likewise be electrically connected in parallel. The first row and the second row can be electrically connected in series. One or more additional rows can have a plurality of thermoelectric modules electrically connected in parallel. The one or more additional rows can be electrically connected in series with one another, with the first row, and with the second row. The assembly can include a third row and a fourth row. Each row can include a plurality of thermoelectric modules electrically connected in parallel. In some embodiments, each of the plurality of rows includes four thermoelectric modules. The first row and the second row can be stacked close together.

The plurality of thermoelectric modules can be oriented such that a high temperature junction of a first thermoelectric module and a high temperature junction of a second thermoelectric module face towards one another. The first thermoelectric module and the second thermoelectric module can each contain an input terminal and an output terminal, the input terminal of the first thermoelectric module and the output terminal of the second thermoelectric module being disposed on a first side, and the output terminal of the first thermoelectric module and the input terminal of the second thermoelectric module being disposed on a second side.

In certain embodiments, the assembly is configured such that the thermoelectric heat pump continues to operate after one or more thermoelectric modules fails until each of the plurality of thermoelectric modules in a row fails.

The assembly can include at least one array connecting member configured to hold the plurality of rows together in a stack.

Each of the plurality of thermoelectric modules can include a first electric terminal and a second electric terminal. The assembly can include a conductor positioning apparatus having a first electrical conductor and a second electrical conductor disposed thereon. Positions of the first electrical conductor and the second electrical conductor can be fixed with respect to the conductor positioning apparatus. At least the first electrical conductor can be configured to electrically connect the first electric terminals of the thermoelectric modules in at least one of the plurality of rows to a first power supply terminal. At least the second electrical conductor can be configured to electrically connect the second electric terminals of the thermoelectric modules in at least one of the plurality of rows to at least one of a second power supply terminal or ground.

The conductor positioning apparatus can include an electrically insulating member. The first electrical conductor and the second electrical conductor can include electrically conductive traces deposited on the electrically insulating member.

The assembly can include a first clip positioned on a first end of the heat transfer region; a second clip positioned on a second end of the heat transfer region opposite the first end; and a bracket secured to the first clip and to the second clip, the bracket extending along a top side of the heat transfer region.

The first clip and the second clip have a shape configured to equalize forces applied across a length of the clip. In some embodiments, the first clip and the second clip are curved. The first clip and the second clip can include tabs configured to insert into slots formed in the bracket to provide secure engagement. The first clip and the second clip can include clip hooks, and the bracket can include bracket hooks. The clip hooks and bracket hooks can be configured to provide secure engagement when a rod is inserted between the clip hooks and the bracket hooks.

The heat transfer region can further include a plurality of elongate heat transfer members operatively connected to the plurality of thermoelectric modules. The bracket can include a spring element configured to allow a length of the bracket to stretch such that the bracket is configured to clamp the row of thermoelectric modules and the plurality of elongate heat transfer members in tight engagement. The spring element can include a depression formed at a position along the length of the bracket. In some embodiments, the spring element includes a shaped surface configured to flatten when tension is applied thereto.

The heat transfer region can further include a plurality of elongate heat transfer members operatively connected to the plurality of thermoelectric modules. The bracket can be configured to hold the row of thermoelectric modules and the plurality of elongate heat transfer members tightly together for at least ten years. The bracket can include a strip of fiberglass-reinforced tape. Thermal interface material can be disposed between the bracket and the thermoelectric modules.

In some embodiments, a plurality of ports for moving fluid into or out from the waste channel and the main channel are stacked in a first direction. In at least some of said embodiments, alternating high and low temperature portions of the heat transfer region are arranged in a second direction, where the second direction is substantially perpendicular to the first direction. In some embodiments, the high temperature portion of the heat transfer region includes a plurality of spatially separated high temperature regions. In some embodiments, the low temperature portion of the heat transfer region includes a plurality of spatially separated low temperature regions. In certain embodiments, thermoelectric modules are positioned and/or oriented to decrease or minimize the number of spatially separated high temperature regions and low temperature regions.

DETAILED DESCRIPTION

A TE heat pump includes one or more TE modules that transfer heat against the thermal gradient from one junction (e.g., a low-temperature junction or main junction) to another (e.g., a high-temperature junction or waste junction). One or more suitable TE materials can be used for this purpose. A first defined channel provides a passageway for waste fluid flow, where the fluid is placed in substantial thermal communication with the high-temperature junction. Fluid flowing in the first defined channel can remove heat from the high-temperature junction. In some embodiments, the waste channel is in communication with a fluid reservoir (e.g., a reservoir in the external environment, such as the atmosphere) or other heat sink. Using a fluid to assist in removal of thermal energy from the high-temperature junction can improve the efficiency of a TE heat pump. The waste channel can be enclosed by any suitable structure, such as, for example, a material that has a low coefficient of thermal conductivity, such as foam, or a structure that provides substantial thermal isolation between the passageway defined by the waste channel and portions of the TE heat pump other than the high-temperature junction(s). A suitable device, such as, for example, a mechanical fan, can be operatively connected to move fluid through the waste channel.

In some embodiments, a TE heat pump includes a second defined channel that provides a passageway for a main fluid flow, where the fluid is placed in substantial thermal communication with the low-temperature junction. The low-temperature junction can be configured to remove heat from fluid flowing in the main channel. In certain embodiments, the main channel is in thermal communication with an area, a physical component, or other matter to be cooled by the TE heat pump. Like the waste channel, the main channel can be configured to provide substantial thermal isolation between the passageway defined by the main channel and portions of the TE heat pump other than the low-temperature junction(s). A suitable device can be operatively connected to move fluid through the main channel. In some embodiments, the direction of fluid movement in the main channel is generally opposite the direction of fluid movement in the waste channel (for example, creating a fluid flow system through the heat pump enclosure including counter-flow of fluids through the main and waste channels). In alternative embodiments, the direction of fluid movement in the waste channel and main channel is substantially the same (for example, creating parallel flow through the heat pump enclosure).

In some heat pump configurations, the main channel can be substantially adjacent to or in close proximity with the waste channel. In certain embodiments, it is advantageous to decrease or minimize heat transfer between fluid in the waste channel and fluid in the main channel.

Figure 1B:
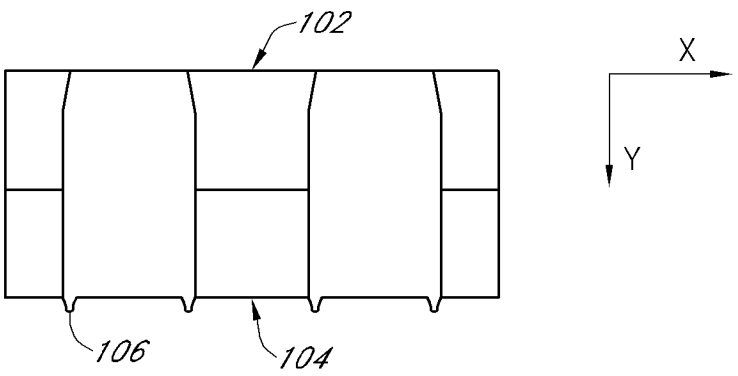
FIG. 1B is a top view of the apparatus shown in FIG. 1A.
Figure 1A:
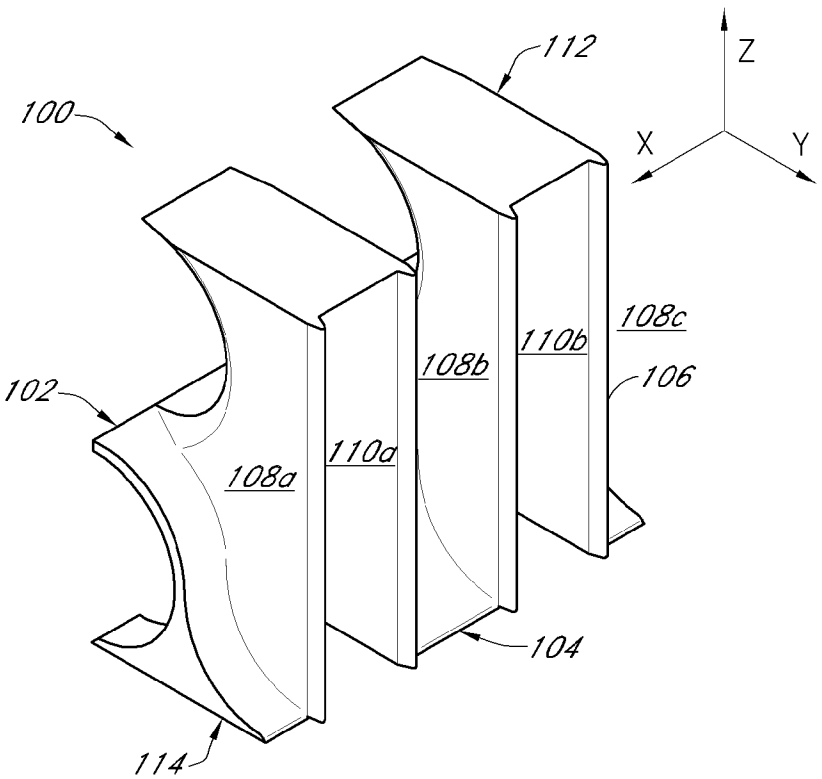
FIG. 1A is a perspective view of an embodiment of an apparatus for channeling air in a thermoelectric device.
Figure 1D:
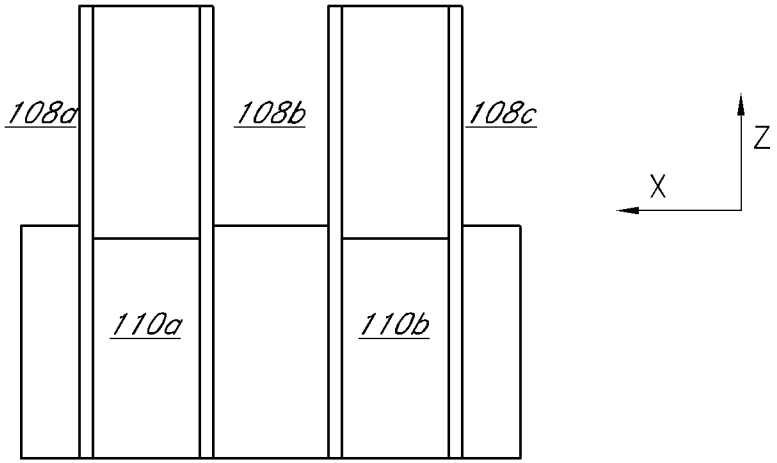
FIG. 1D is a side view of the apparatus shown in FIG. 1A.
Figure 1C:
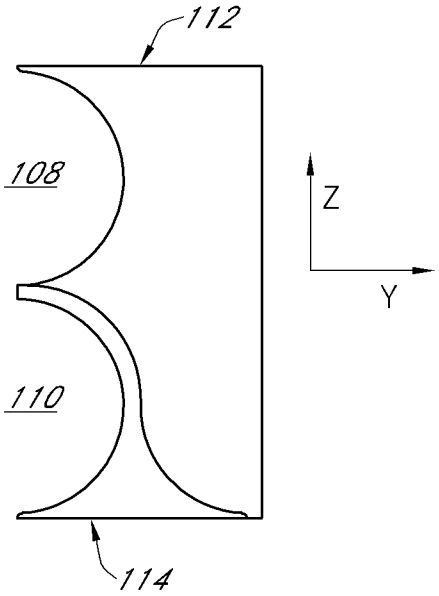
FIG. 1C is an end view of the apparatus shown in FIG. 1A.
Figure 1E:
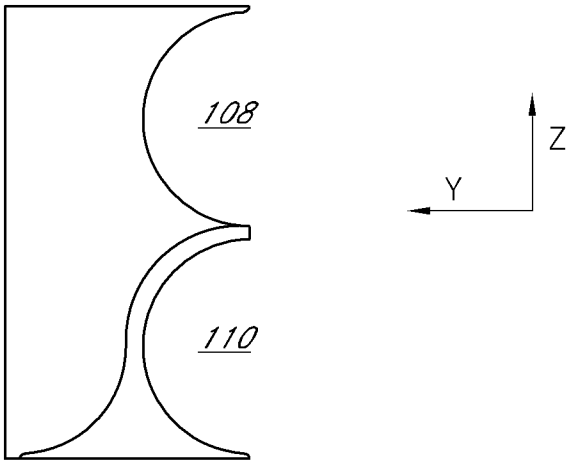
FIG. 1E is another end view of the apparatus shown in FIG. 1A.
Figure 2A:
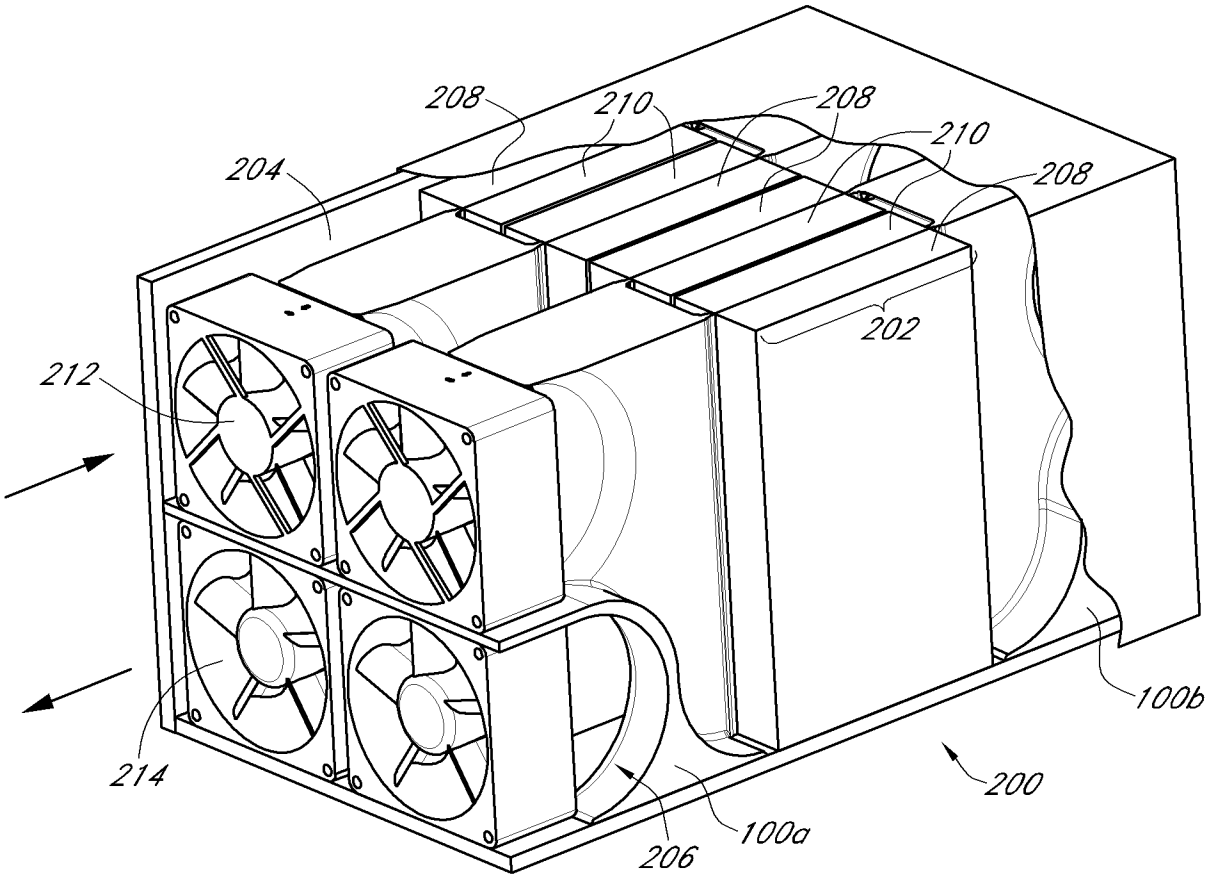
FIG. 2A is a schematic diagram of an enclosure for a thermoelectric device incorporating the air channeling apparatus shown in FIG. 1A.
Figure 2B:
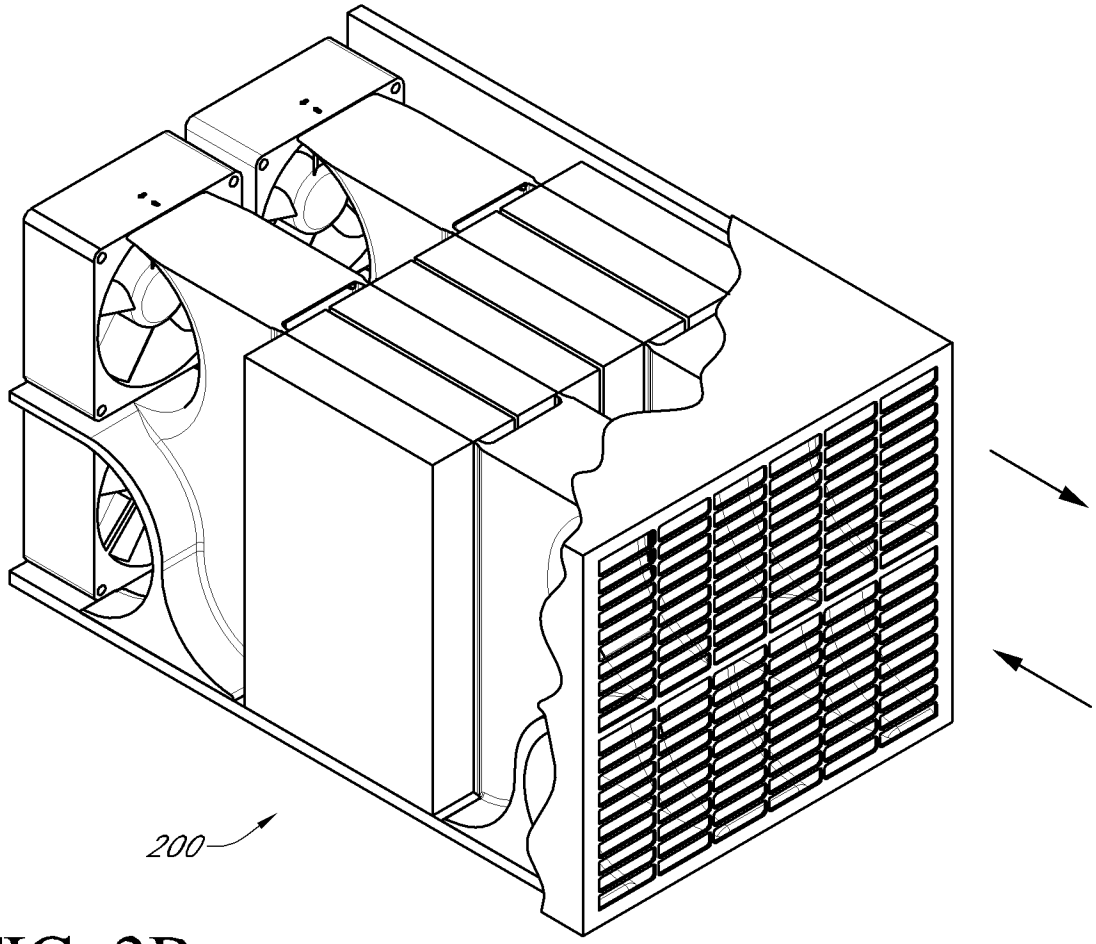
FIG. 2B is another view of the schematic diagram shown in FIG. 2A.
Figure 3B:
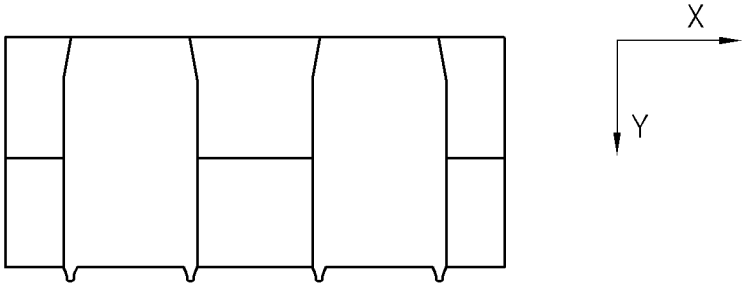
FIG. 3B is a top view of the apparatus shown in FIG. 3A.
Figure 3A:
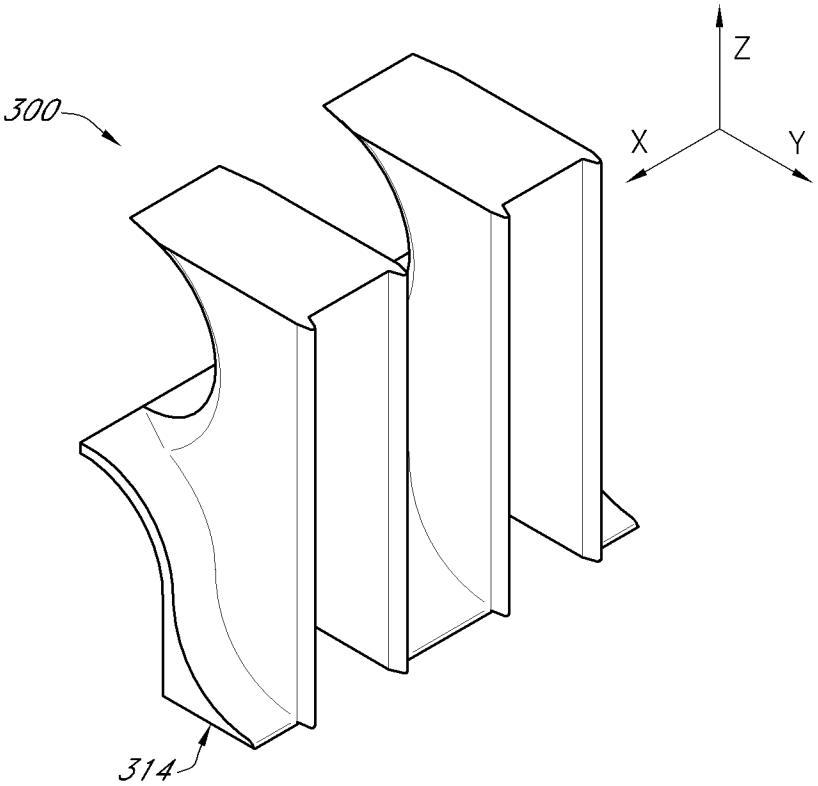
FIG. 3A is a perspective view of another embodiment of an apparatus for channeling air in a thermoelectric device.
Figure 3D:
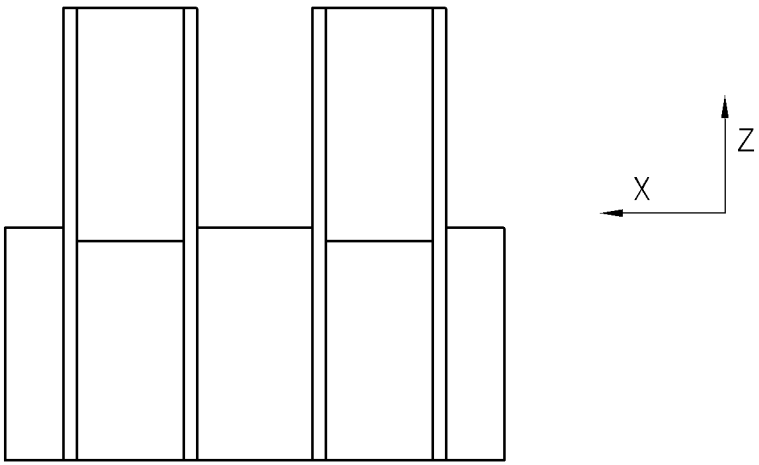
FIG. 3D is a side view of the apparatus shown in FIG. 3A.
Figure 3C:
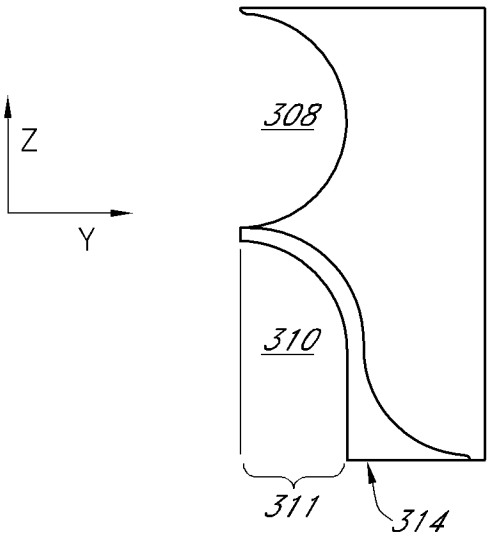
FIG. 3C is an end view of the apparatus shown in FIG. 3A.
Figure 3F:
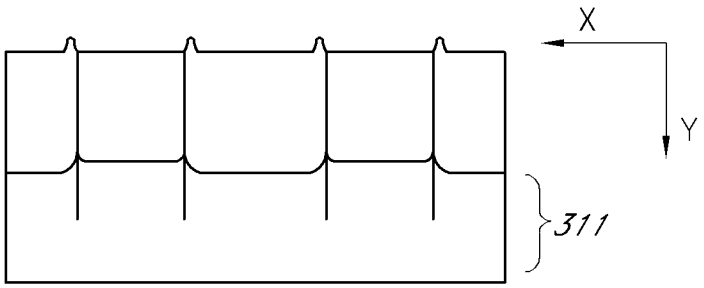
FIG. 3F is a bottom view of the apparatus shown in FIG. 3A.
Figure 3E:
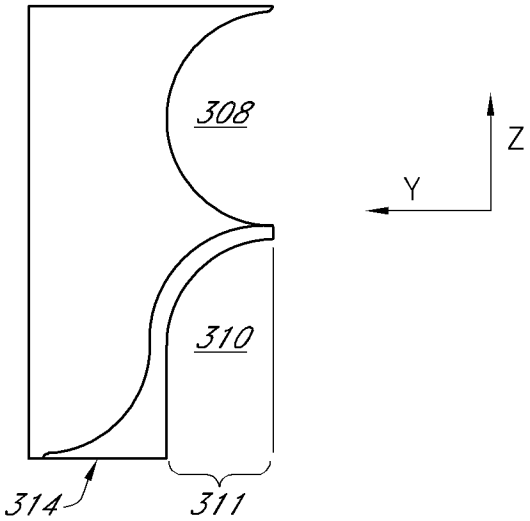
FIG. 3E is another end view of the apparatus shown in FIG. 3A.

In the embodiment shown in FIGS. 1A-1E, an apparatus 100 (sometimes called a channel enclosure, an air guide, or a guide) provides channels 108, 110 for fluid flow in a TE heat pump 200 (FIGS. 2A-2B). The guide 100 has a first side 102 configured to face away from TE material (e.g., towards equipment to be cooled or towards the outside environment) and a second side 104 configured to face towards TE material. The second side 104 can have projections 106, or slots to assist in secure or airtight engagement with heat transfer regions within the heat pump. The guide 100 defines a waste channel 108 that can diverge into one or more passageways 108*a*, 108*b*, 108*c*. The passageways of the waste channel 108 provide for thermal communication between the environment outside the TE heat pump 200 and regions of the heat pump in thermal communication with one or more high-temperature junctions of the TE materials. The guide 100 defines a main channel 110 that can also diverge into one or more passageways 110*a*, 110*b*. The passageways of the main channel 110 provide for thermal communication between the environment outside the TE heat pump 200 and regions of the heat pump in thermal communication with one or more low-temperature junctions of the TE materials.

The channels 108, 110 formed by the guide 100 shown in FIGS. 1A-1E are stacked in a vertical arrangement on the first side 102 of the apparatus. The channels 108, 110 are configured to move fluids such that they flow through TE materials separated into horizontally-arranged heat transfer regions. In some embodiments, the channels 108, 110 are shaped and positioned such that fluids flowing therethrough can reach the full geometric extent of associated heat transfer regions. For example, in the illustrated embodiment, the heat transfer region extends from the top edge 112 to the bottom edge 114 of the apparatus. Accordingly, the passageways of the channels 108, 110 on the second side 104 of the guide 100 also extend from top 112 to bottom 114. In other embodiments, heat transfer regions can have any arbitrary orientation with respect to the channels.

FIGS. 2A-2B show an enclosure for a TE heat pump 200 that includes a heat transfer region 202 positioned between a pair of the guides 100*a*-*b* illustrated in FIGS. 1A-1E. The heat pump 200 includes a waste channel 204 for a waste fluid flow that passes through high-temperature regions 208 of the heat transfer region 202. The waste fluid flow removes thermal energy from the heat pump 200 as it passes from a first end to a second end of the heat pump. One or more fans 212 can be used to provide movement of fluid from the first end, through the high-temperature heat transfer region 208, and to the second end, as indicated by the arrows shown adjacent to the waste channel 204 in FIGS. 2A-2B. Alternatively, the fans 212 can be used to move the waste fluid flow from the second end to the first end. As used in this disclosure, the term "fan" broadly refers to any suitable device for moving air or other fluids, including, without limitation, an oscillating fan, a blower, a centrifugal fan, a motorized fan, a motorized impeller, a turbine, or a mechanical device configured to move fluids through a channel. In some embodiments, the TE heat pump includes redundant fans. The fans can be wired in parallel or in series with one another.

The heat pump 200 also includes a main channel 206 for a main fluid flow that passes through low-temperature regions 210 of the heat transfer region 202. The heat pump 200 removes thermal energy from the main fluid flow as it passes from the second end to the first end. One or more fans 214 can be used to move fluid from the second end, through the low-temperature heat transfer region 210, and to the first end, as indicated by the arrows shown adjacent to the main channel 206 in FIGS. 2A-2B. Alternatively, the fans 214 can be used to move the main fluid flow from the first end to the second end. In the illustrated embodiment, the path of the main fluid flow can be substantially parallel to the path of the waste fluid flow or substantially opposite the path of the waste fluid flow (for example, in a counter-flow arrangement).

The heat pump 200 can include an array of thermoelectric modules (TE modules) within the heat transfer region 202. For example, the device may contain between four and sixteen thermoelectric modules or another suitable number of modules, such as a number of modules appropriate for the application for which the heat pump 200 is intended. A door or panel (not shown) in the case of the heat pump can provide access to the internal components of the heat pump, including, for example, the air channels 204, 206, the fans 212, 214, and/or the TE modules.

One or more fans can be used to push or pull air through the device from a vent in an end of the device, for example. For example, the fans can pull or push air through the device from a first end and/or a second opposite end. As used in the context of fluid flow, the term "pull" broadly refers to the action of directing a fluid generally from outside the device to inside the device. The term "push" broadly refers to the action of directing a fluid generally from inside the device to outside the device. The fans can be positioned within a fan enclosure or another suitable housing. A channel enclosure or air guide 100 can be seated beneath the fan enclosure.

In some embodiments, the main side of the device 200 (for example, the side associated with the main fans 214) can be inserted into an enclosure, for example, in order to cool the interior of the enclosure. In some embodiments, the waste side of the device 200 (for example, the side associated with the waste fans 212) is exposed to the ambient air, a heat sink, a waste fluid reservoir, and/or a suitable region for expelling a waste fluid flow. In certain embodiments, waste fluid flow is prevented from entering the main channel. For example, the exhaust of the waste channel can be separated from the intake of the main channel by a wall, a barrier, or another suitable fluid separator.

Figure 4A:
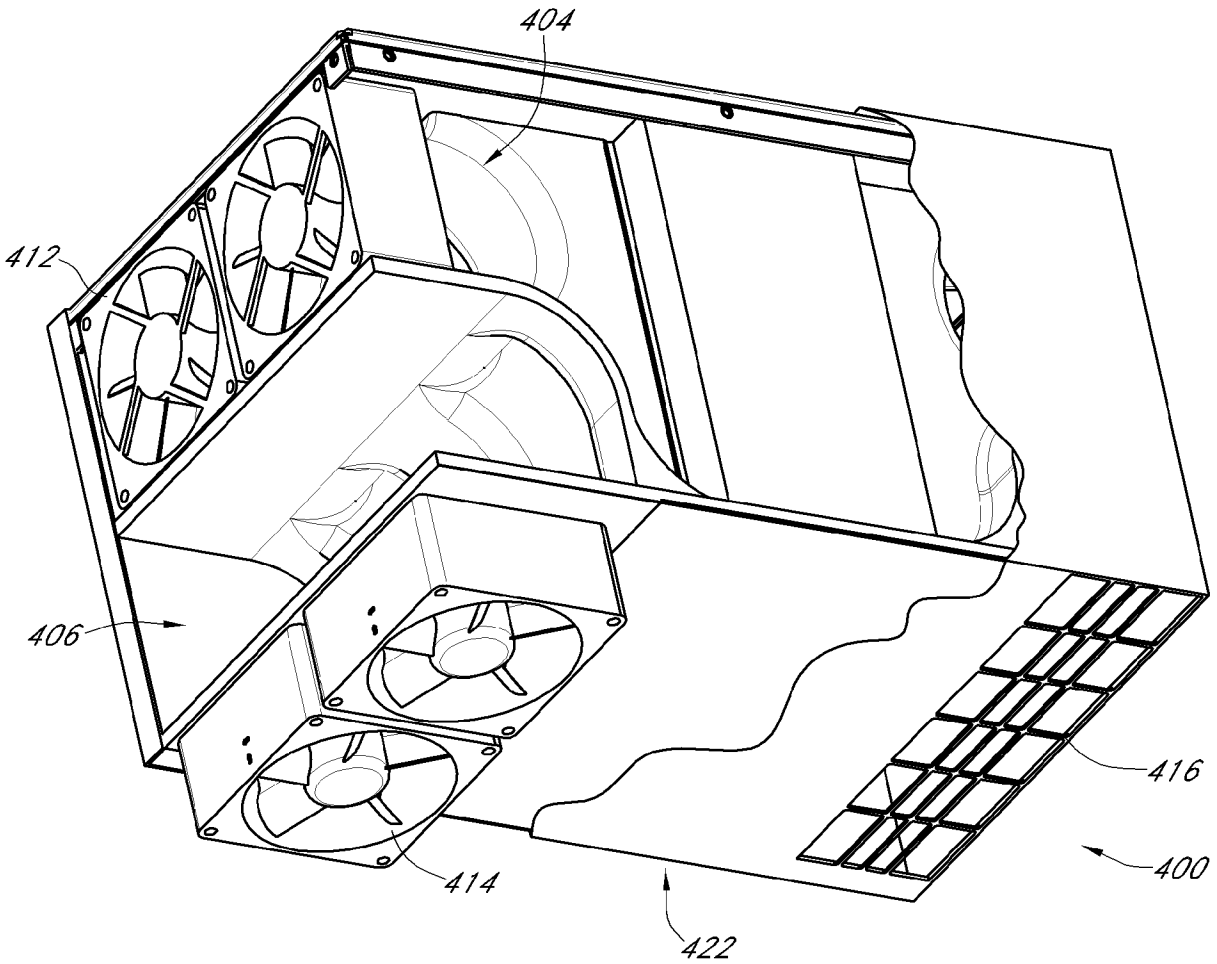
FIG. 4A is a schematic diagram of an enclosure for a thermoelectric device incorporating the air channeling apparatus shown in FIG. 3A.
Figure 4B:
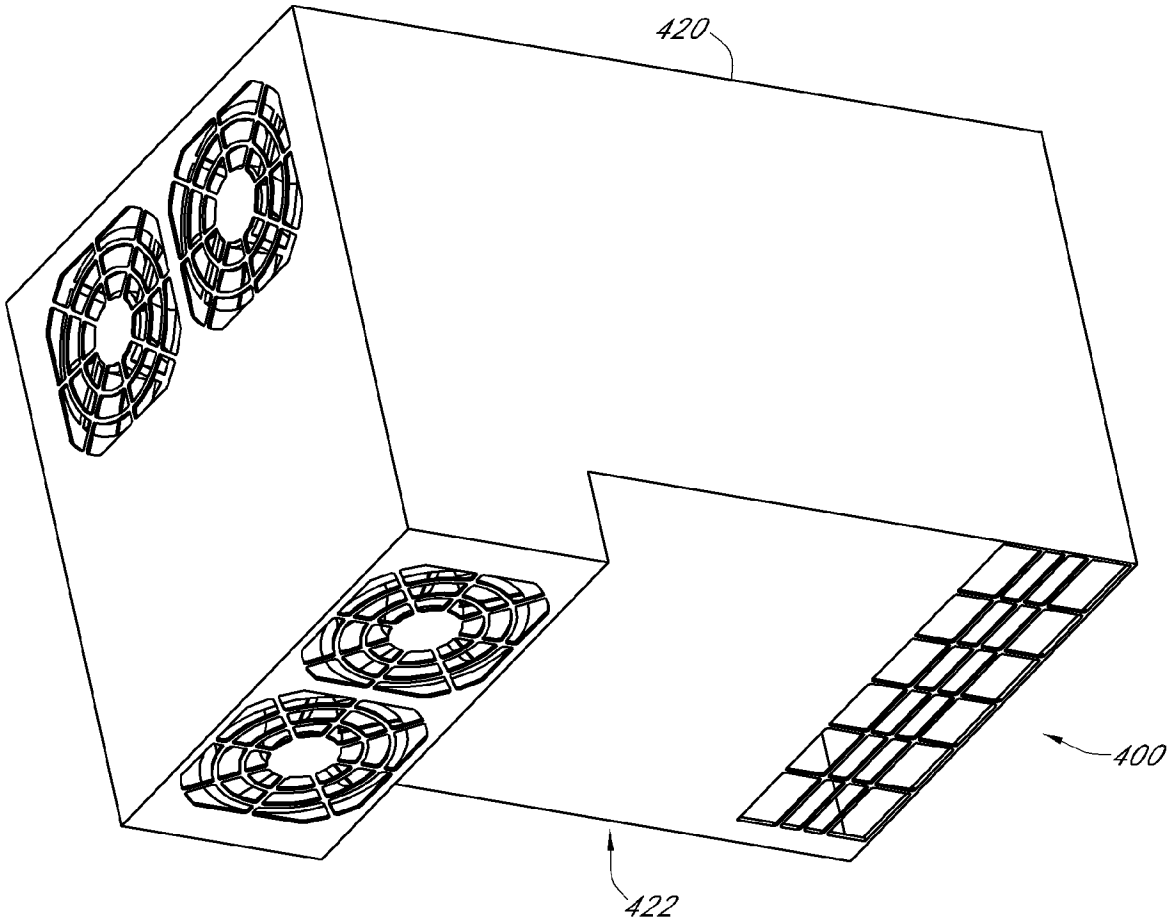
FIG. 4B is another view of the schematic diagram shown in FIG. 4A.

In various embodiments described herein, fans can be configured to pull or push air through a TE device, and fans can be mounted in various positions in the TE device. The flow patterns inside the TE device can include substantially parallel flow, counter flow (e.g., flow in substantially opposite directions), cross flow (e.g., flow in substantially perpendicular directions), and/or other types of flow depending upon, for example, the fan direction and/or the position(s) in the TE device where the fans are mounted. In some embodiments, a TE device includes one or more waste fans for directing fluid flow through a waste channel and one or more main fans for directing fluid flow through a main channel. In certain embodiments, fans are positioned on the same end or on different ends of a device, where the end refers to a portion of the device on one side of a TE module. The following are example configurations and corresponding flow patterns:

1. Waste fan pushes, main fan pushes, waste and main fans on same end—fluid flow system includes substantially parallel flow
2. Waste fan pushes, main fan pushes, waste and main fans on different ends—fluid flow system includes substantially counter flow
3. Waste fan pulls, main fan pulls, waste and main fans on same end—fluid flow system includes substantially parallel flow
4. Waste fan pulls, main fan pulls, waste and main fans on different ends—fluid flow system includes substantially counter flow
5. Waste fan pushes, main fan pulls, waste and main fans on same end—fluid flow system includes substantially counter flow
6. Waste fan pushes, main fan pulls, waste and main fans on different ends—fluid flow system includes substantially parallel flow
7. Waste fan pulls, main fan pushes, waste and main fans on same end—fluid flow system includes substantially counter flow
8. Waste fan pulls, main fan pushes, waste and main fans on different ends—fluid flow system includes substantially parallel flow In another embodiment shown in FIGS. 3A-3F, a guide 300 provides channels 308, 310 for fluid flow in a TE heat pump 400 (FIGS. 4A-4B). The guide 300 is similar to the guide 100 shown in FIGS. 1A-1E, except that the main channel 310 of the guide 300 includes an aperture 311 on the bottom surface 314 that allows fluid in the main channel 310 to enter or exit through the bottom of the heat pump 400.

As shown in FIGS. 4A-4B, the heat pump 400 can be housed in an enclosure 420 that is configured to allow ingress and egress of fluid through a bottom portion 422 of the heat pump. For example, fans 414 that move fluid through the main channel 406 can be situated in a plane substantially perpendicular to the plane in which fans 412 that direct fluid through the waste channel 404 are located. A fluid port 416 for the main channel 406 can also be at least partially positioned on the bottom of a main side 422 of the enclosure 420.

In some embodiments, fans 414 pull air in through the main side 422 of a heat pump 400 and direct the air into the main side channels, through main side heat exchanger fins (not shown), and the air exits at the opposite end through the port 416 of the main side 422. In some embodiments, fans 412 are mounted at the case surface of the waste side. The waste fans and/or the main fans can be mounted next to the housing wall. Fans can also be mounted adjacent to air holes or vents, such as, for example, port 416.

Figure 12:
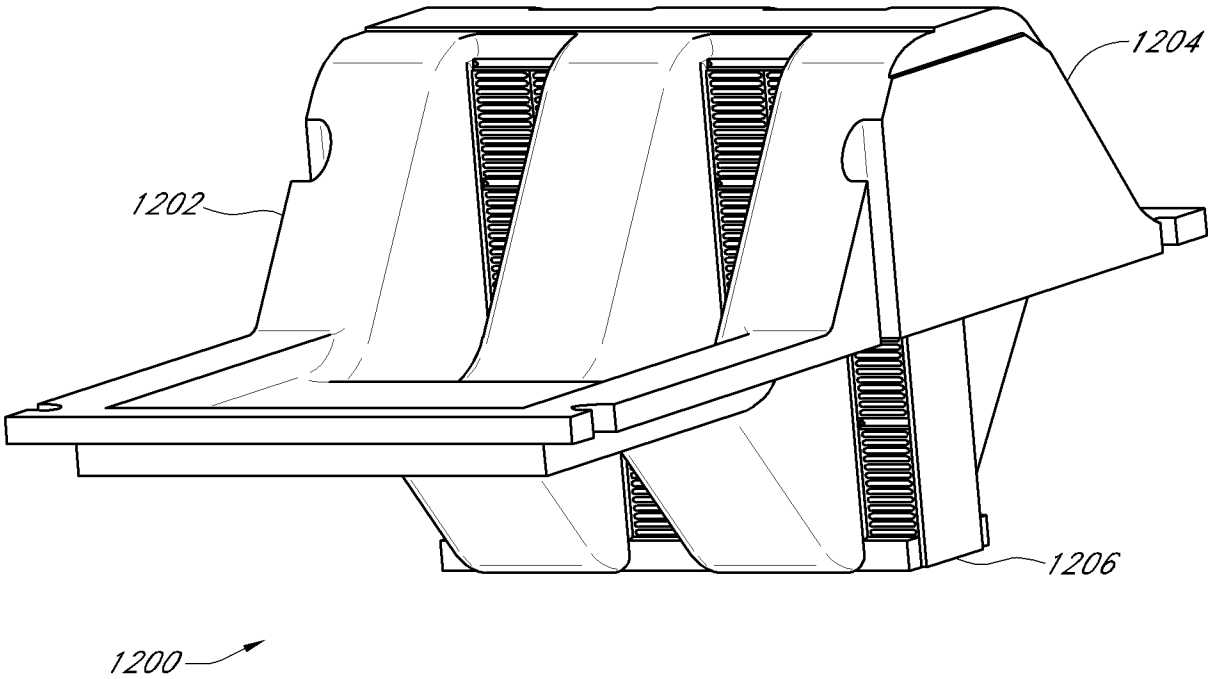
FIG. 12 is a perspective view of portions of a thermoelectric device enclosure.

FIG. 12 shows a perspective view of certain assembled internal components 1200 of a TE heat pump. The heat pump assembled components include foam channels 1202, 1204 and an array of TE modules 1206 positioned within the foam channels. In some embodiments, the array 1206 transfers thermal energy away from a main fluid flow (for example, air flowing through a main fluid channel 110) and into a waste fluid flow (for example, air flowing through a waste fluid channel 108). In some embodiments, the main fluid flow is directed into the array 1206 by the foam channels 1202 on a first end of the heat pump 1200 and out of heat pump via the foam channels 1204 on a second opposite end of the heat pump. The waste fluid flow can be directed in the same way or directed into the array 1206 by the foam channels 1204 on the second end and out of the heat pump 1200 via the foam channels 1202 on the first end.

Figure 5:
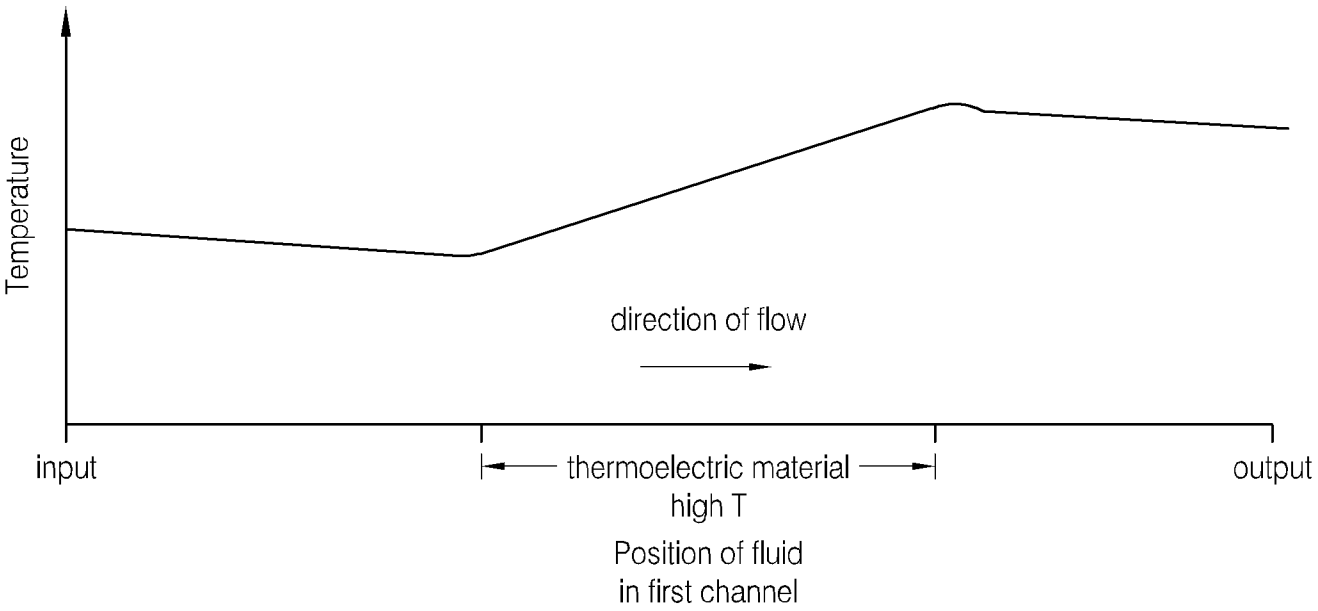
FIG. 5 is a chart showing an example relationship between fluid temperature and position in a waste fluid channel of a thermoelectric device.
Figure 6:
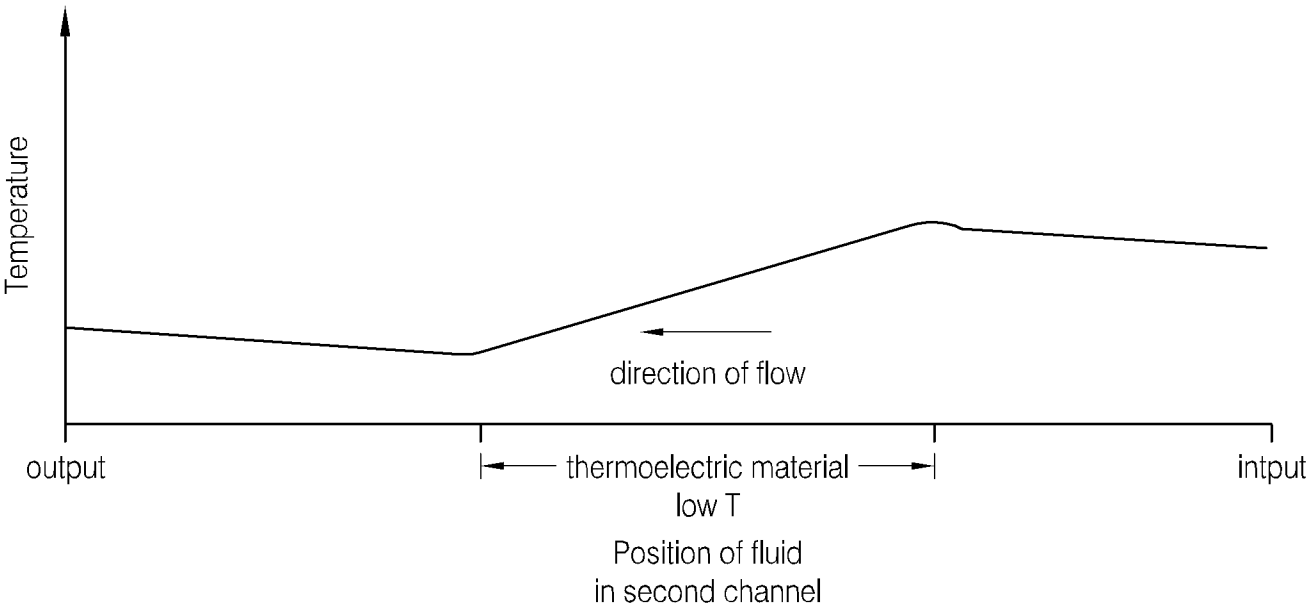
FIG. 6 is a chart showing an example relationship between fluid temperature and position in a main fluid channel of a thermoelectric device.

FIG. 5 and FIG. 6 show example temperature variations within the main and waste fluid channels of some heat pump configurations described herein. In some embodiments, temperature differences between fluid channels (such as, for example, between a waste channel 204 and a main channel 206, as shown in FIGS. 2A-B) is substantially decreased or minimized during operation of a TE heat pump. FIG. 5 shows an example relationship between fluid temperature and position in a waste fluid channel of a thermoelectric device. FIG. 6 shows an example relationship between fluid temperature and position in a main fluid channel of a thermoelectric device. The waste fluid channel, for example, may include fluid in positions that are adjacent to or near corresponding fluid positions in the main fluid channel. For example, corresponding positions can include positions of fluid disposed near opposite sides of an enclosure wall or thermoelectric module that separates the waste fluid channel from the main fluid channel. These portions of the fluid flow in the waste and main fluid channels can be said to be at "corresponding positions" within the heat pump.

In some embodiments associated with the information shown in FIG. 5 and FIG. 6, the direction of fluid flow in the waste channel is substantially opposite the direction of fluid flow in the main fluid channel. Accordingly, changes in fluid temperatures at corresponding positions along the length of the heat pump are typically in the same direction, although the temperature magnitudes and temperature change magnitudes may vary between the channels. By maintaining fluid flow in substantially opposite directions, the heat pump is configured to decrease or minimize temperature differences between the fluids in the channels along the length of the heat pump and/or at ends of the heat pump. In some embodiments, the thermal gradient between the channels along the length of the heat pump is decreased and thermal isolation of the fluids in the channels is improved by fluid flow characteristics.

Assemblies of TE modules can be stacked one on top of another to make a line of TE module assemblies when more than one TE module is used. Multiple TE modules may be used, for example, in order for a TE device to provide adequate cooling power for an enclosure, a piece of equipment, or some other space. In some embodiments, an array of TE module assemblies including multiple rows of TE module assemblies can be used to provide increased cooling power in a TE device. The channel enclosures disclosed herein can be used to route air or other fluids through the main side (for example, the side of the TE device that cools air) and the waste side (for example, the side that exhausts heated air). In some embodiments, a channel enclosure keeps the two air flows (for example, the main air flow and the waste air flow) from mixing.

Figure 23B:
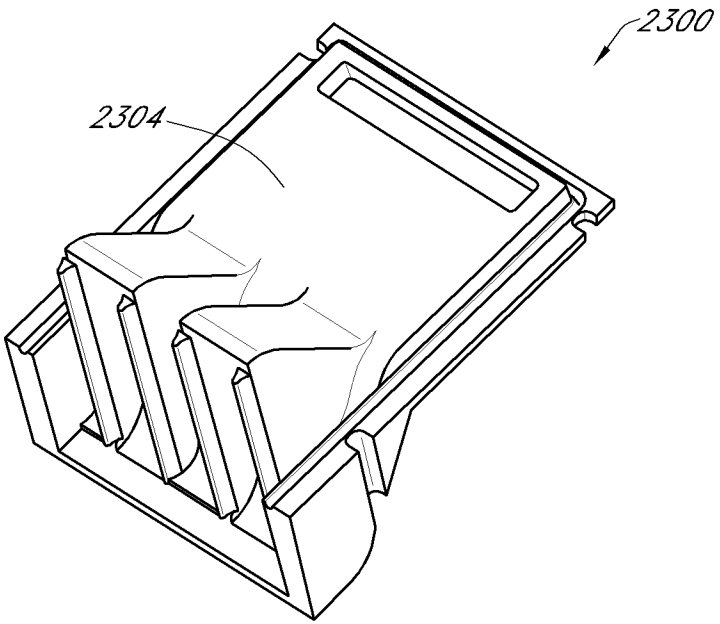
FIGS. 23A-23B are views of a fluid channeling enclosure for use in some thermoelectric device embodiments.
Figure 23A:
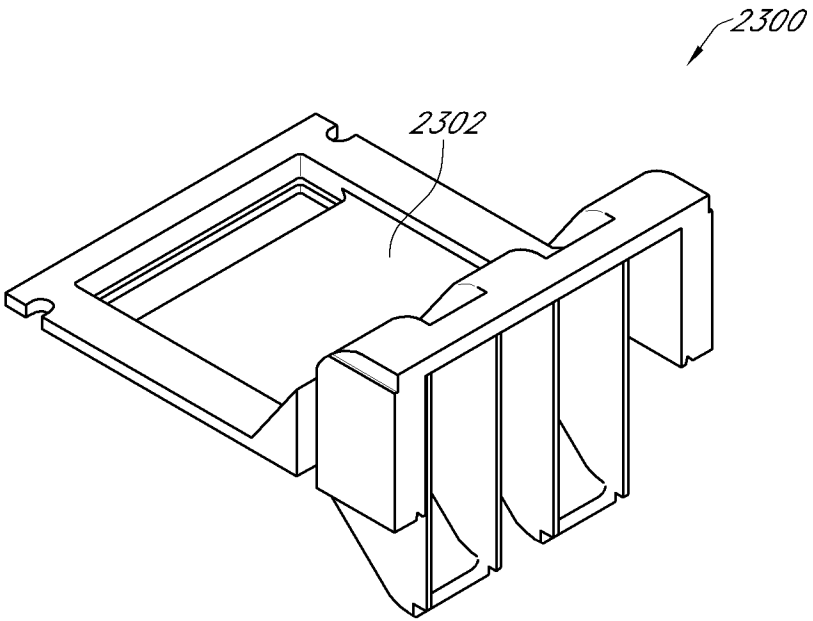

FIGS. 23A-B show perspective views of a top side 2302 of a channel enclosure 2300 and a bottom side 2304 of the enclosure 2300. The illustrated enclosure includes passageways configured to suitably route fluid flows through an array of thermoelectric modules when the channel enclosure 2300 is operatively connected within a TE device. The channel enclosure can be made from any suitable material, including, for example, an insulating material, a foamed material, Gset® (a material available from Fagerdala World Foams AB of Gustavsberg, Sweden), a composite material, a copolymer of polystyrene and polyphenylene oxide, or a combination of materials. In certain embodiments, the thermal conductivity of the material from which the channel enclosure is made does not exceed about 0.03 W/K. In some embodiments, an injection molding machine is used to fabricate the channel enclosure 2300.

Figure 7:
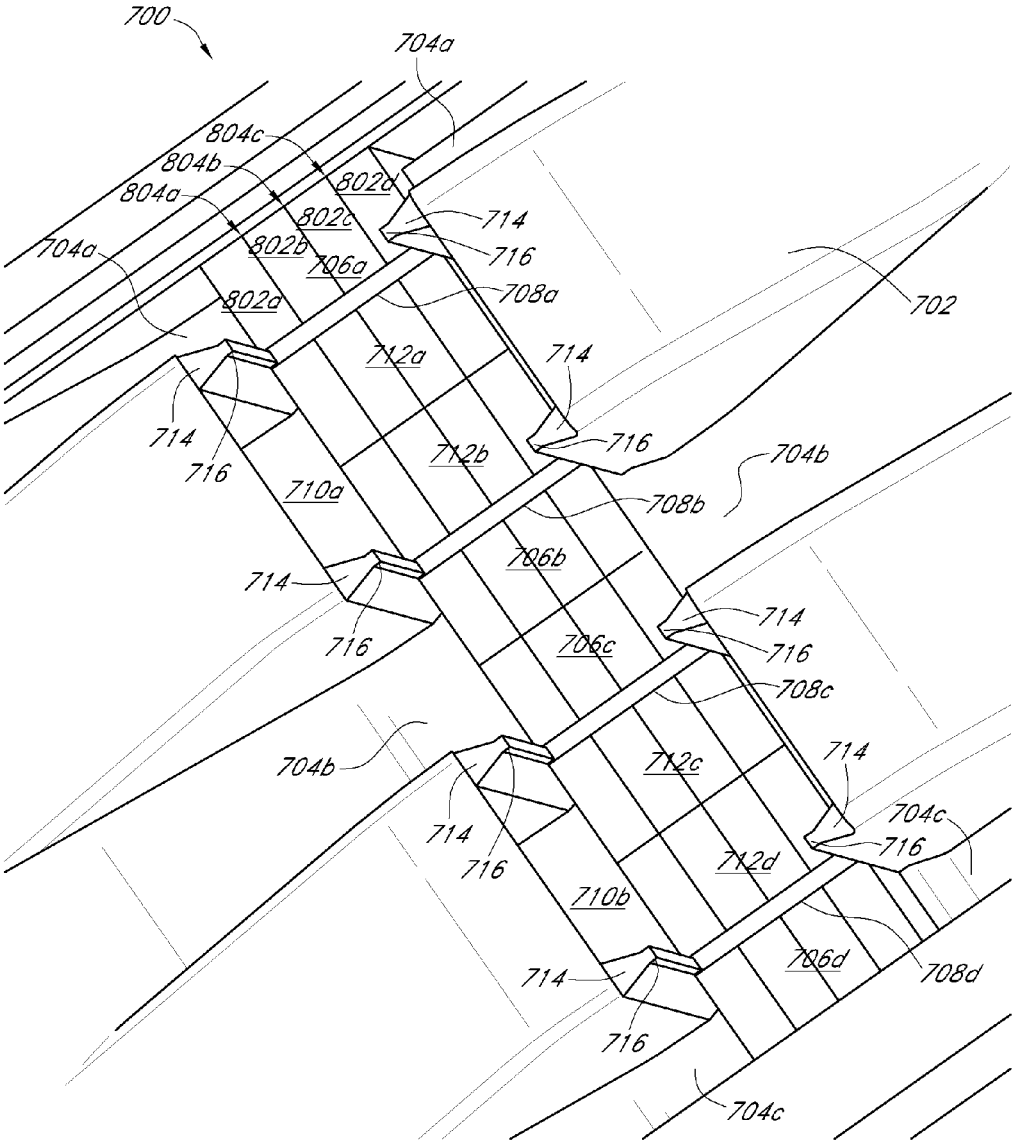
FIG. 7 is a perspective view of portions of an enclosure for a thermoelectric device.

In the embodiment shown in FIG. 7, a channel enclosure 702 divides a main fluid stream flowing on the main side of a TE device 700 into streams (or flows) that travel through multiple passageways 704*a-c*. The passageways 704*a-c* direct the flows across main heat transfer members 706*a-d* (e.g., cooled fins) operatively connected within an array of TE module assemblies. The main heat transfer members 706*a-d* are operatively connected to main sides of respective TE modules 708*a-d*. In some embodiments, the channel enclosure provides passageways 710*a-b* on the waste side that similarly direct a waste fluid stream across waste heat transfer members 712*a-d* (e.g., heated fins). The waste heat transfer members 712*a-d* are operatively connected to waste sides of the TE modules 708*a-d*. In some embodiments, the heat transfer members 706, 712 overhang the TE modules 708 to some extent along the sides of the TE module assemblies (e.g., at junctions between the TE module assemblies and the channel enclosure 702).

In certain embodiments, the main fluid stream and the waste fluid stream are separated physically and thermally by the channel enclosure 702. The channel enclosure 702 can be made from a suitable thermal insulator, such as, for example, foam, a multi-layer insulator, aerogel, a material with low thermal conductivity (e.g., a material with thermal conductivity not greater than 0.1 W/(m×K)), another suitable material, or a combination of suitable materials. In some embodiments, the channel enclosure 702 includes projections 714 that separate the waste and main flows at junctions between the channel enclosure 702 and the TE module assemblies. In certain embodiments, one or more of the projections 714 has a feature 716 at its end that nestles between heat exchanger fins 706, 712 that overhang the TE modules 708. In some embodiments, the feature 716 includes a trapezoidal (or other suitably shaped) section of foam or another suitable material that is between about six and about eight millimeters in width. A sealant, such as, for example, caulking, gel, silicone, or urethane can be carefully applied to portions of the channel enclosure 702 that contact the TE modules 708.

In the embodiment shown in FIG. 7, the heat transfer members 706, 712 are divided into segments 802*a-d* separated by gaps 804*a-c*. The gaps 804*a-c* extend in a direction substantially perpendicular to the direction of fluid flow through the passageways 704, 710. The segments 802*a-d* decrease thermal energy transfer within the heat transfer members 706, 712 along a path extending from one end of the TE device to the other end of the device. In some embodiments, the TE device includes heat transfer members 706, 712 having a plurality of separated fin sections 802 operatively connected to each side of the thermoelectric modules 708. Any suitable number of fin sections 802 can be used, including more than two sections, four sections, or between two and ten sections. The heat transfer members can be installed by, for example, attaching the fins 802 to the TE modules 708 manually, attaching the fins using a machine, and/or attaching the fins to the modules 708 with a thermal interface material. Thermal interface materials (or thermally conductive materials) include, without limitation, adhesive, glue, thermal grease, phase change material, solid material, foil, solder, soft metal, graphite, liquid metal, or any other suitable interface material.

In some embodiments, the heat transfer members 706, 712 are secured in place using a thermally conductive grease to achieve good thermal contact with the module 708 surface. In some embodiments (e.g., when the fins of heat transfer members 706, 712 are divided into multiple fin sections 802), certain steps may be taken to ensure that the fin sections 802 remain in fixed relative positions with respect to one another. For example, in certain embodiments, the fin sections 802 of each fin are made in one piece (as discussed in more detail below), and the fins can be clamped together and attached to the modules 708 using grease.

In certain embodiments, the efficiency of the TE device 700 is improved when thermal isolation in the direction of flow is increased. Using heat transfer members 706, 712 divided into multiple segments 802 can increase the thermal isolation within the heat transfer members 706. In some embodiments, using heat transfer members 706, 712 made of high thermal conductivity material (e.g., Al or Cu) without multiple segments 802 can cause the heat transfer member 706, 712 to have little thermal isolation in the direction of fluid flow.

Figure 8A:
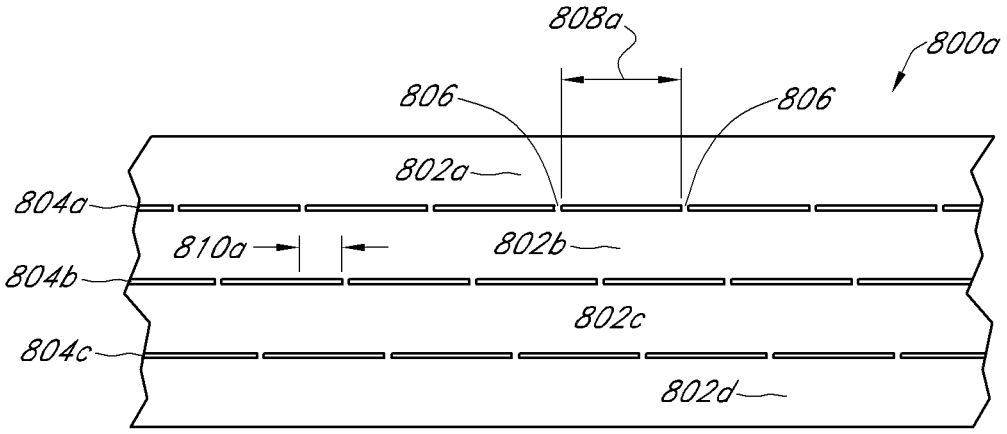
FIG. 8A is a schematic diagram of heat transmitting members in a thermoelectric device.
Figure 8B:
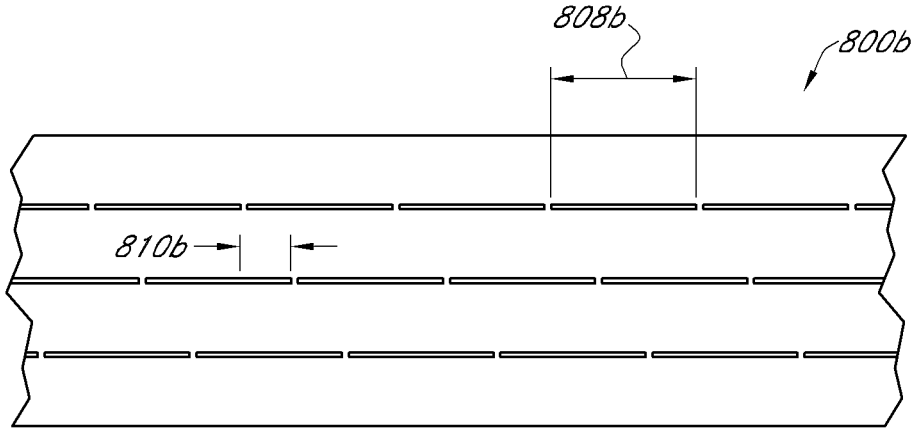
FIG. 8B is another schematic diagram of heat transmitting members in a thermoelectric device.

FIGS. 8A-8B illustrate a one-piece main fin 800*a* and a one-piece waste fin 800*b*, respectively, configured for attachment to a thermoelectric module 708. In the illustrated embodiments, the fins 800 are configured to create thermal isolation in the direction of fluid flow. The fins 800 are separated into segments 802*a-d* by a plurality of gaps 804 (or slits). One-piece fin construction is achieved by having the fin sections 802 connected tenuously by narrow bridges 806 along the length of the material. In some embodiments, the bridges 806 are sufficiently narrow to maintain minimal thermal conductivity in the direction of flow. For example, in certain embodiments, the bridges 806 are less than ten millimeters in width, less than two millimeters in width, about one millimeter in width, or not more than about one millimeter in width. In certain embodiments, the bridges 806 occur at arbitrary locations along the fin segments 802. In some embodiments, there are a sufficient number of bridges 806 between fin segments 802 such that the fin 800 handles substantially the same as a unitary fin 800 without segments when the fin 800 is folded up. For example, the bridges 806 may be spaced at various intervals 808, including intervals of more than ten millimeters, less than thirty millimeters, about twenty millimeters, more than ten times the width of the bridges 806, more than fifteen times the width of the bridges 806, about twenty times the width of the bridges 806, or another suitable interval. In some embodiments, the interval 808*a* between bridges 806 on a main fin 800*a* differs from the interval 808*b* between bridges 806 on a waste fin 800*b*.

In some embodiments, the positioning of the bridges 806 is designed to stiffen the structure of the fins 800. For example, in certain embodiments, the positions of the bridges 806 along the segments 802 are staggered at an interval 810 so that they do not line up with one another through the width of the fins 800. In some embodiments, the stagger interval 810*a* in the position of bridges 806 on a main fin 800*a* differs from the stagger interval 810*b* in the position of bridges 806 on a waste fin 800*b*.

Figure 9A:
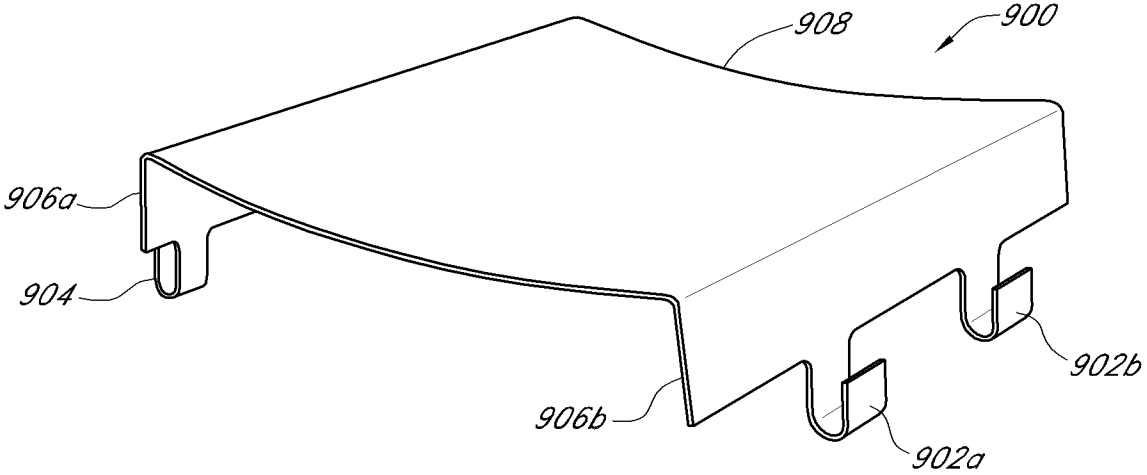
FIG. 9A illustrates a clip used in some thermoelectric device enclosure embodiments.

FIG. 9A illustrates a clip 900 that can form part of a thermoelectric module assembly. The clip 900 includes a base 908 from which two or more legs 906*a-b* extend in a generally perpendicular orientation with respect to the base 908. The legs 906 can have equal lengths or different lengths, depending on the configuration of the assembly. Multiple curved hooks 902*a-b*, 904 extend out from the legs 906*a-b*. In some embodiments, the base 908 of the clip 900 is curved. For example, the base 908 can be shaped such that, when the legs 906*a-b* are pulled in a direction away from the base 908 (for example, when the hooks 902*a-b*, 904 are attached to an object that puts tension the clip 900), the force generated by the clip on a thermoelectric module assembly is uniform across the surface of the base 908. In some embodiments, the base 908 has a parabolic shape, and attaching the clip 900 to an assembly adds forces to the clip 900 that cause the base 908 to flatten.

Figure 9B:
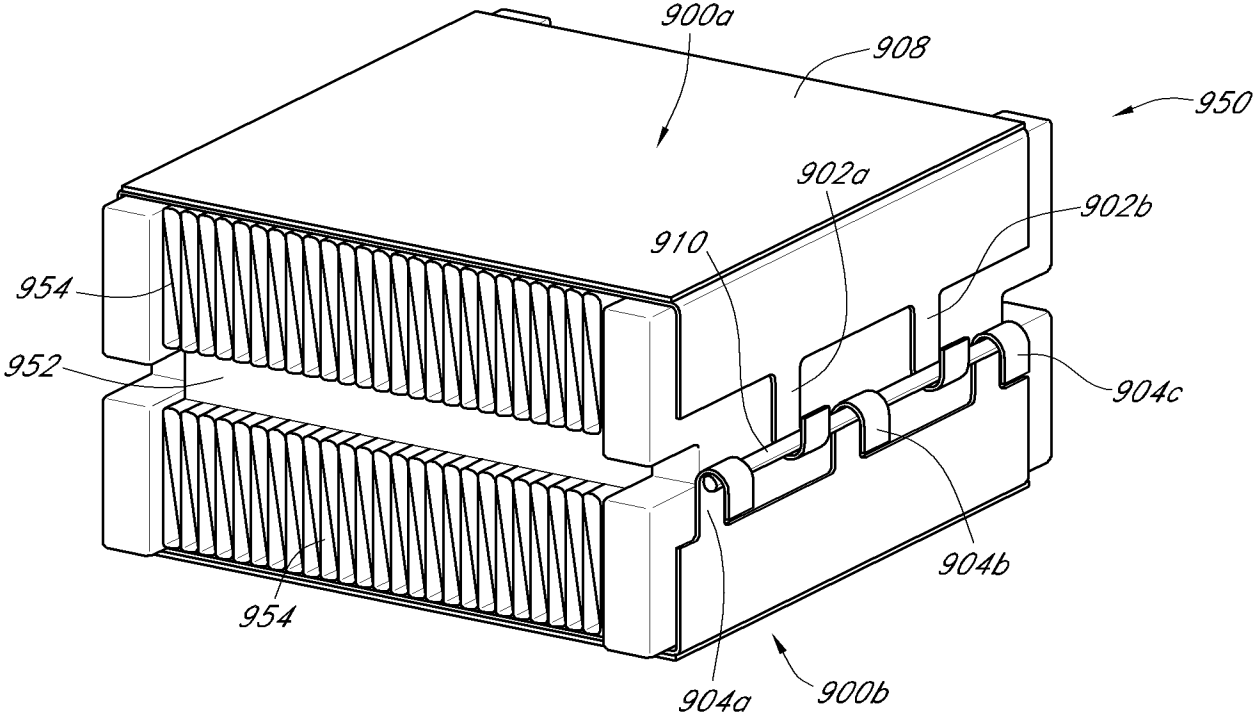
FIG. 9B illustrates a thermoelectric module and heat transmitting members with clips.

The thermoelectric module assembly 950 shown in FIG. 9B includes two identical clips 900*a-b* that have hooks 902*a-b*, 904*a-c* extending towards one another from the base 908 of each clip 900*a-b*. A pin 910 is inserted between curved portions of the hooks 902, 904 such that the hooks are held together tightly. The clips 900*a-b* encase a thermoelectric material 952 that is attached to fins 954. The fins 954 transfer thermal energy to and from the thermoelectric material 952. The shape of the clips 900*a-b* can be such that the distribution of force is even across the length of the clip at contact points between the clip and a TE module.

Figure 10:
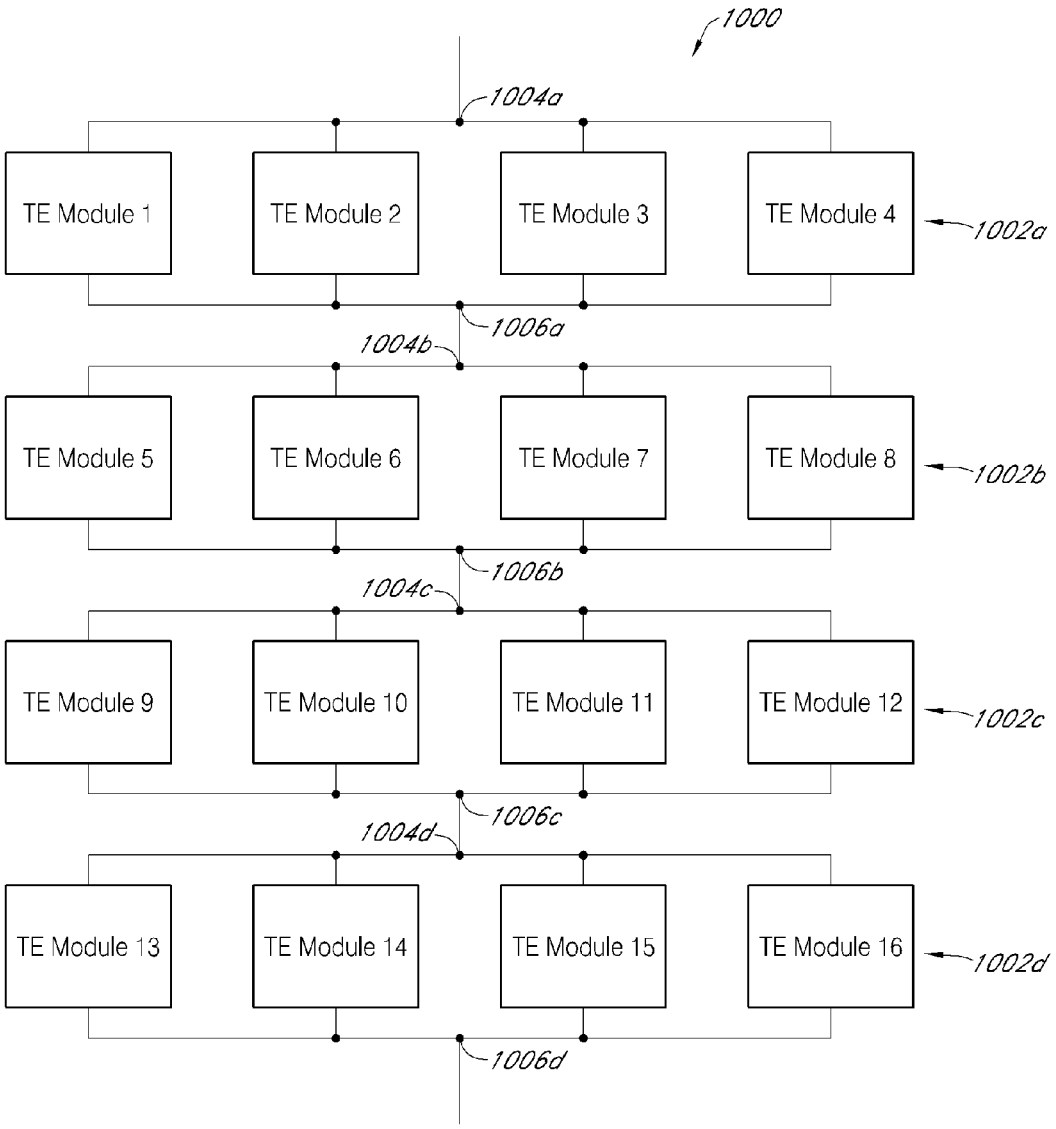
FIG. 10 is a schematic diagram of an electrical network in a thermoelectric device.

FIG. 10 is a schematic diagram of an array 1000 of thermoelectric modules. In the illustrated embodiment, four rows 1002*a-d* of four thermoelectric modules each are operatively connected to form an array 1000 of sixteen thermoelectric modules. Each row includes a plurality of thermoelectric modules connected in parallel between a row input 1004 and a row output 1006. Each row output 1006 is connected in series with another row input 1004, except that the first input 1004*a* and the last output 1006*d* are connected to a power supply. This electrical topology can be called a "series-parallel" arrangement of thermoelectric modules. In some embodiments, a heat pump employing a series-parallel array 1000 of thermoelectric modules can continue to operate after one or more modules within the array 1000 fail. For example, the heat pump can be configured to continue operation until all of the modules in at least one row fail.

Figure 11:
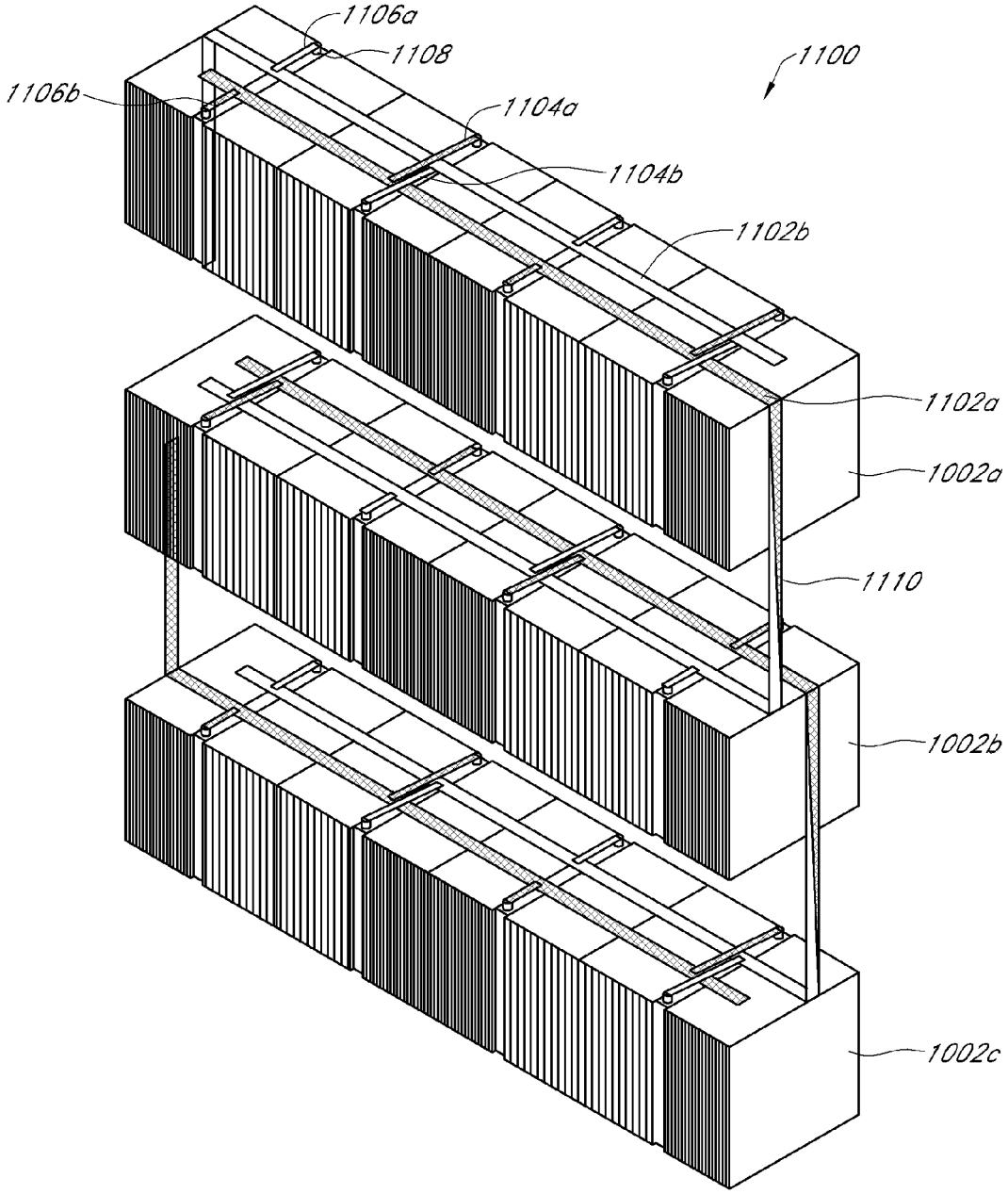
FIG. 11 is a perspective view of an array of thermoelectric modules with wiring.

FIG. 11 illustrates a mechanical wiring arrangement for an array 1100 of modules in some embodiments. While the illustrated array 1100 includes twelve modules in three rows 1002*a-c*, any suitable number of modules and rows 1002 of modules can be incorporated into the array 1100. For example, in some embodiments, a TE heat pump includes an array with six, eight, twelve, sixteen, between four and fifty, or a number of modules suitable to cool a target piece of equipment with acceptable performance.

Figure 13:
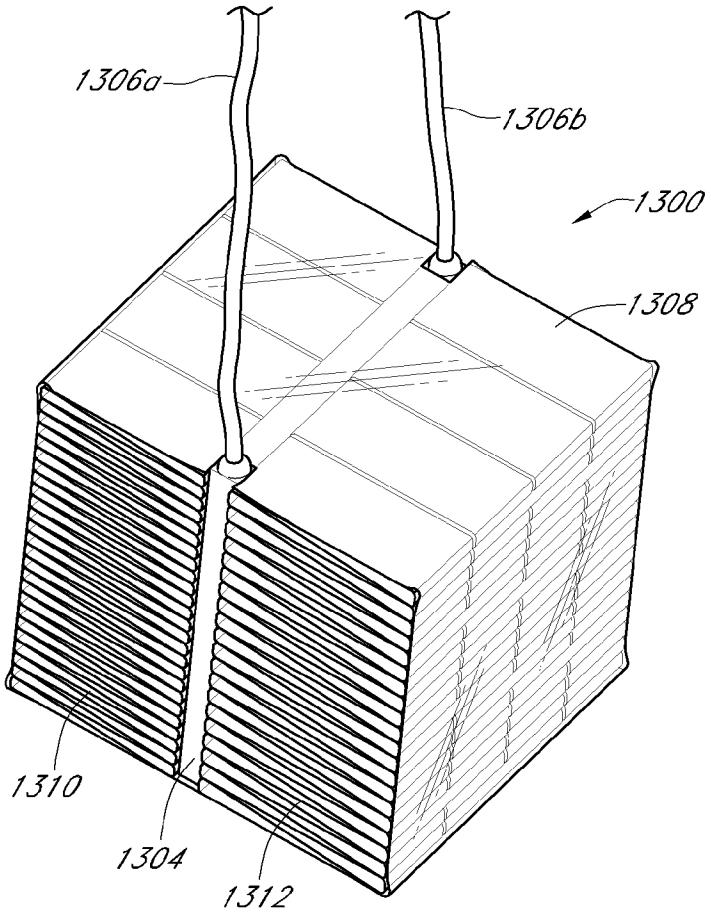
FIG. 13 illustrates heat transmitting members attached to a thermoelectric module.

FIG. 13 illustrates an individual thermoelectric module 1300. The module 1300 includes heat exchangers (or fins) 1310, 1312 positioned on opposite sides of thermoelectric material 1304. In some embodiments, the configuration of the fins 1310 connected to the main side (or low temperature side) of the thermoelectric material 1304 differs from the configuration of the fins 1312 connected to the waste side (or high temperature side) of the thermoelectric material 1304. For example, the main fins 1310 can be shorter and more densely packed than the waste fins 1312. Some or all module assemblies 1300 in a thermoelectric module array can be configured in this way. Providing longer and less densely packed waste fins 1312 can allow greater fluid flow through the waste side of the TE module.

In some embodiments, heat is pumped from one side to the other by the action of the TE module when electricity is applied to the module. The conductive materials within the module have a non-zero electrical resistivity, and the passage of electricity through them generates heat via Joule heating. In some embodiments, the main side is cooled by pumping heat from the main side to the waste side. Joule heating within the module generates heat that is passed to the main side and the waste side. For example, half of the Joule heating may go to the waste side and half to the main side. Consequentially, the heat being added to the waste heat exchange fluid can be greater than the heat being removed from the main side heat exchange fluid. In some embodiments, creating larger fluid flow on the waste side than on the main, for example, by providing waste side fins that are bigger and less dense than main side fins, can allow higher flow rate on the waste side without excessive restriction of waste fluid flow.

In the embodiment shown in FIG. 13, the heat exchangers 1310, 1312 include four fin segments. This can help achieve performance improvements, such as improvements discussed in U.S. Pat. No. 6,539,725, the entire contents of which are incorporated by reference herein and made a part of this specification. The fins 1310, 1312 can be glued onto the surface of the thermoelectric material 1304 or attached in another suitable way. In the illustrated embodiment, the fins 1310, 1312 extend beyond the edges of the thermoelectric material 1304 in the direction of flow. The extensions can allow an insulating material to be positioned between the fins, which can help prevent the hot (for example, waste) and cold (for example, main) fluid streams from mixing. The module assembly 1300 can be wrapped with tape 1308. The tape 1308 can help protect the fins 1310, 1312 from being bent and can electrically insulate the fins 1310, 1312 from electrical elements (for example, wires 1306*a-b*) that might otherwise contact them.

Returning to FIG. 11, illustrated are wires 1102, 1104, 1106, 1110 used to connect the modules within the array 1100 together electrically. Each row 1002*a-c* is wired in a series circuit to other rows via a conductor 1110, and modules within a row 1002 are connected in a parallel circuit to other modules within the row 1002 via conductors 1102, 1104, 1106. In some embodiments, the wires 1102, 1104, 1106, 1110 are thin and uninsulated, and an insulator (for example, tape) is disposed between the wires and the modules to prevent shorting out the wires to the fins. In some embodiments, the modules that are next to each other in a row 1002 are arranged so that adjacent modules have main sides facing one another or have waste sides facing one another. This arrangement can decrease or minimize the number of channels for which a channel enclosure (for example, the channel enclosure shown in FIG. 1A or FIG. 3A) provides ducting. In the embodiment shown in FIG. 11, the main fins are shown tightly spaced, and the waste fins have a wider spacing. The spacing of the fins can facilitate various heat transfer capabilities. Other features of the fins can also be used to affect fin heat transfer capability, such as, for example, different shape, material, lengths, etc. In some embodiments, corresponding contacts 1108 for the module wiring alternates sides along the length of the row 1002. For example, the modules within a row 1002 may be alternately rotated to achieve the simpler ducting arrangement. In some embodiments, the wiring within a row 1002 includes module wires 1104*a-b* that are bent over across another wire to reach the appropriate terminal 1108. The wiring arrangement also includes module wires 1106*a-b* that do not cross another wire to reach the appropriate terminal 1108. In some embodiments, the module wires 1104, 1106 are insulated to prevent shorting to other wires.

In some embodiments, the rows 1002*a-c* of modules are configured to be stacked close together in a vertical direction. For example, the wires 1102*a-b* can be substantially thin or ribbon-like to facilitate close stacking of module rows. The rows 1002*a-c* shown in FIG. 11 are separated by exaggerated gaps in to show the wiring configuration between rows.

In some embodiments, a method of assembling TE modules includes taping flat copper conducting strips across a row of TE modules held together by tape. Module wires can be attached to the copper strips by bending them over the strips, cutting the wires, stripping the wires, and soldering the wires to the flat copper strips. Additional rows of TE modules can be similarly assembled and stacked together. The array can be held together by taping the array around its periphery.

In some embodiments, when the rows 1002*a-c* are stacked on top of one another, the surfaces of the heat exchangers do not actually touch. Instead, they can be separated by the thickness of the wire insulation of the module wires 1104*a-b* that are bent over to be attached (for example, soldered) to the metal strips or contacts 1108. In some embodiments, these separations create leak paths by which fluid can pass through the array of modules without being heated or cooled. Furthermore, the air paths can also leak from one side of the heat pump to the other (for example, from one air channel to another). In some embodiments, the cracks are filled with a sealing agent such as, for example, silicone rubber sealant, caulk, resin, or another suitable material.

Some embodiments provide an assembly that substantially eliminates leak paths without the use of sealing agents. In addition, some embodiments provide a method of assembling two dimensional arrays of TE module assemblies with improved consistency and dimensional control. Some embodiments provide a TE device assembly with robust mechanical strength and integrity. Some embodiments reduce the likelihood of damage to heat exchange members within module assemblies and reduce the likelihood of wiring errors while manufacturing module assemblies.

In further embodiments, a method of assembling an array of TE modules includes providing one-piece segmented fins having narrow connecting tabs between adjacent fin sections. Thermal interface material can be applied between the fins and TE materials. The fins can be secured to the TE materials using clips, such as, for example, the clip 900 shown in FIGS. 9A-B. In some embodiments, the clips include legs having asymmetric lengths. In some embodiments, the leg lengths are adjustable using a forming tool. The clips can be held together with a suitable attachment device, such as, for example, hooks and pins or tabs and slots. The clips can be used to hold together a row of TE modules. A bracket, which can include hooks and/or slots, can be used to span the length of a row between the clips. Module wires can include short solid conductors.

Array assemblies can include two kinds of TE modules, having different starting pellet polarity. The modules can include identifying marks for distinguishing between the different kinds. The identifying marks can include, such as, for example, different module wire colors or another distinguishing feature. A printed circuit board (PCB) can be positioned beside each row of modules and can provide electrical conductors for supplying power to the modules. Wires (such as, for example, substantially thin or flat wires) soldered to PCB pads can provide connections between rows of modules. Other wires can be soldered to PCB holes to connect a power supply to the array of modules. In some embodiments, the channel enclosure includes a recess, an aperture, or a cavity that provides a space for power supply lead wires to be connected to the array of modules.

Figure 14:
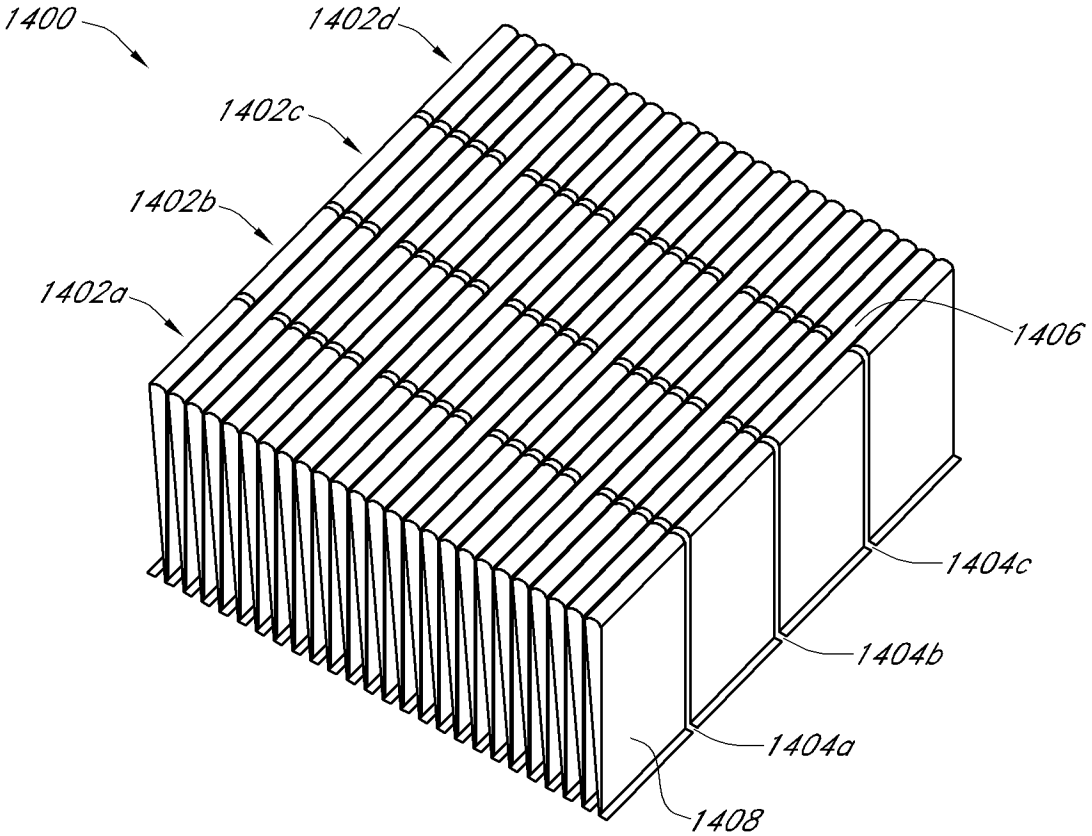
FIG. 14 is a schematic diagram showing segmented fins for use with a thermoelectric device.

FIG. 14 illustrates a perspective view of a main side heat exchanger 1400. The heat exchanger 1400 is separated into four fin sections 1402*a-d* by gaps 1404*a-c* between the fin sections. The fin sections are connected by bridges 1406 that are disposed every sixth fin 1408 between adjacent fin sections (for example, fin sections 1402*c* and 1402*d*). The bridges can be staggered between rows of fin sections by two fins or by another suitable number of fins. The heat exchanger 1400 can be constructed from any suitable material, such as, for example, annealed aluminum, tempered aluminum, or a material with high thermal conductivity. The heat exchanger 1400 can be constructed from a material of suitable thickness, such as, for example, material that is about 0.25 mm thick. The heat exchanger 1400 can include a suitable number of fins 1408, such as, for example, fifty fins or between twenty and one hundred fins, and can be configured to compress and/or expand in at least one dimension. In some embodiments, the heat exchanger 1400 is at least about 40 mm in length when the heat exchanger is in a compressed condition. The heat exchanger 1400 can include fins 1408 of any suitable height, such as, for example, about 21 mm, and fins 1408 of any suitable flow length, such as, for example, about 10 mm. In some embodiments, the heat exchanger 1400 has a total flow length of at least about 40 mm.

In certain embodiments, at least some heat exchangers in a row of TE modules are approximately twice as wide as other heat exchangers. For example, some heat exchangers can extend from a surface of a first TE module to an opposite surface of a second adjacent TE module in the same row. Heat exchangers positioned at the ends of the row can be narrower. In other embodiments, all heat exchangers in a row of TE modules are substantially the same width. In further embodiments, waste heat exchangers and main heat exchangers have different widths.

Figure 15B:
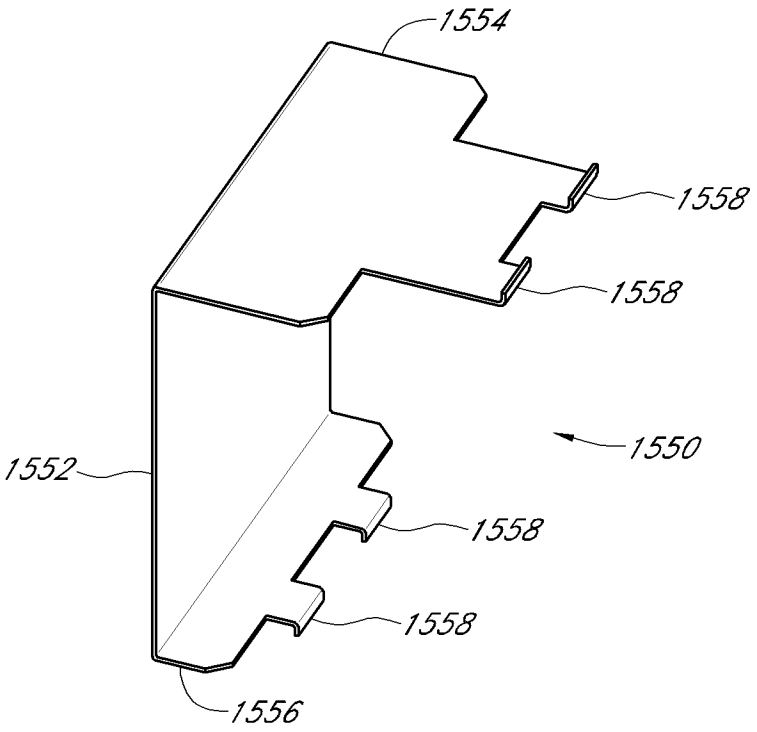
FIGS. 15A-15B illustrate clips for use in some thermoelectric device embodiments.
Figure 15A:
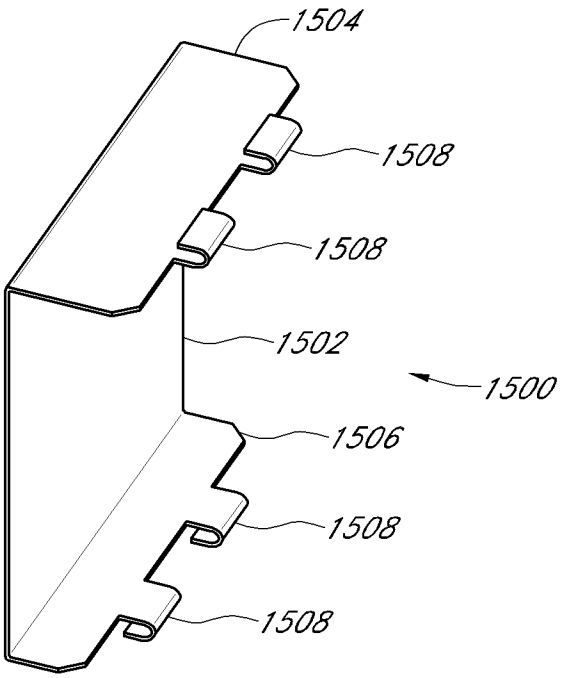

FIG. 15A shows an embodiment of a clip 1500 that includes a base 1502 with asymmetric legs 1504, 1506 extending generally perpendicularly therefrom. The lengths of the legs 1504, 1506 can be adjusted using a forming tool such that the clip 1500 can securely engage a row of TE modules. In the illustrated embodiment, the legs have a plurality of hooks 1508 extending away from the base. The hooks 1508 can be curved or have any other suitable shape and can be configured to securely engage a bracket with hooks and a pin inserted therebetween (for example, the bracket 1700 shown in FIG. 17A).

FIG. 15B shows an alternative embodiment of a clip 1550 that includes a base 1552 with asymmetric legs 1554, 1556 extending therefrom. The longer leg 1554 includes a narrowed portion with tabs 1558 extending away from the base 1552. The shorter leg 1556 also has tabs 1558 configured to securely engage slots (for example, the slots 1758 in the bracket 1750 shown in FIG. 17B).

Figure 16A:
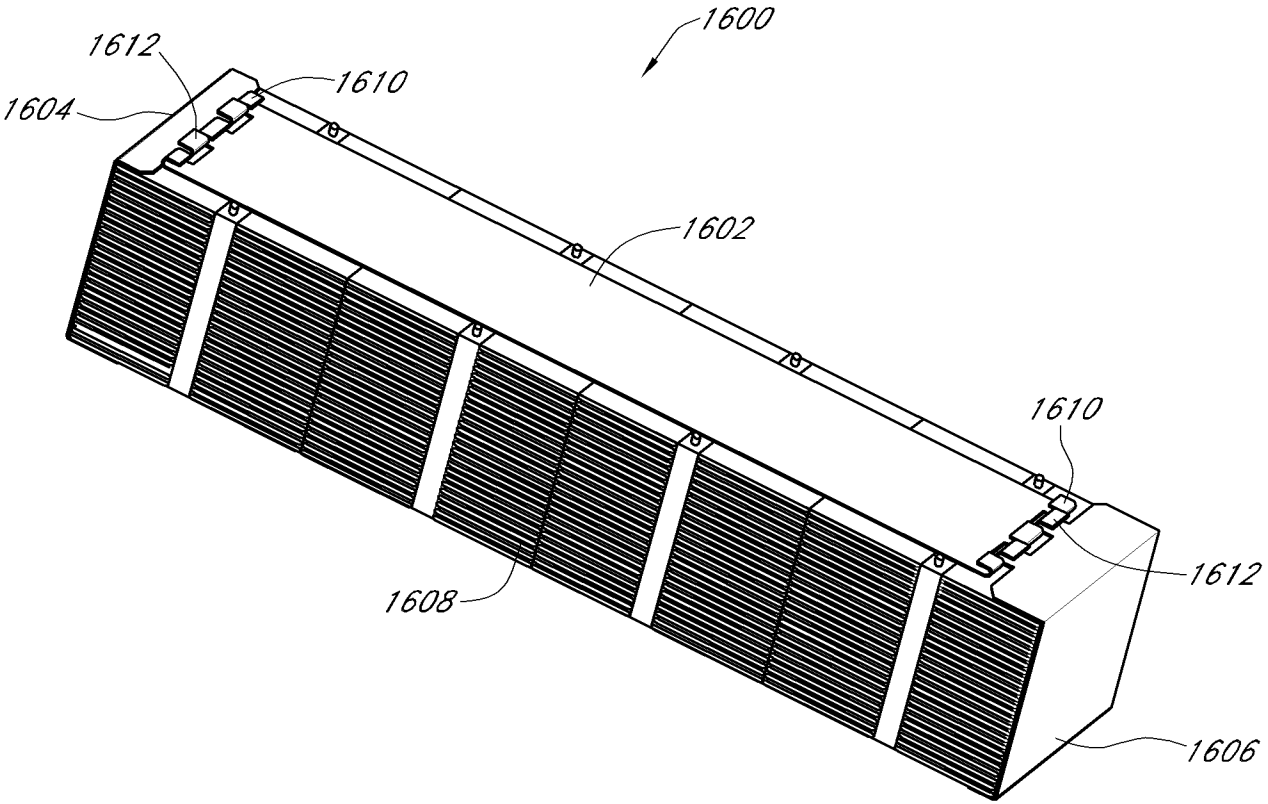
FIGS. 16A-16B show configurations for a row of thermoelectric modules for use in some thermoelectric device embodiments.

FIG. 16A shows a row 1600 of TE modules 1608 assembled with at least one bracket 1602 connecting a pair of clips 1604, 1606. The bracket and clips hold the TE modules 1608 within the row 1600 together. Matching sets of bracket hooks 1610 and clip hooks 1612 can form a secure connection between the bracket 1602 and clips 1604, 1606 when a securing pin (not shown) is inserted through the hooks 1610, 1612. In an alternative embodiment, the rows are held together with rigid tape (for example, fiberglass-reinforced tape) that is designed to stretch at most minimally over long periods of time. In such alternative embodiments, the rigid tape can replace the brackets 1602. In some embodiments, the clips and brackets are constructed from a suitable material, such as, for example, metal, 300 series stainless steel, spring temper material, carbon steel, beryllium copper, beryllium nickel, or a combination of materials.

Figure 16B:
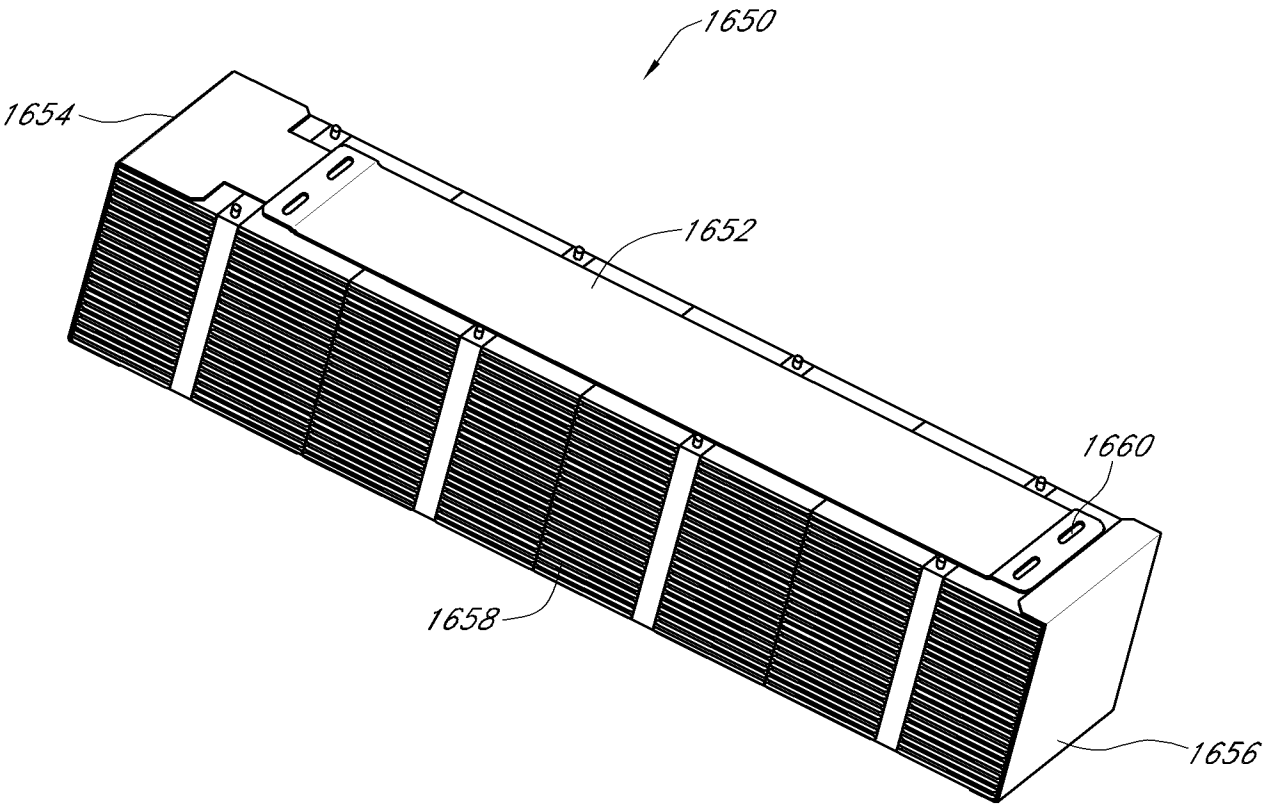

FIG. 16B shows a row 1650 of TE modules 1658 assembled with a least one bracket 1652 connecting a pair of clips 1654, 1656. The clips 1654, 1656 have tabs that securely engage slots 1660 formed in the bracket 1652.

Figure 17B:
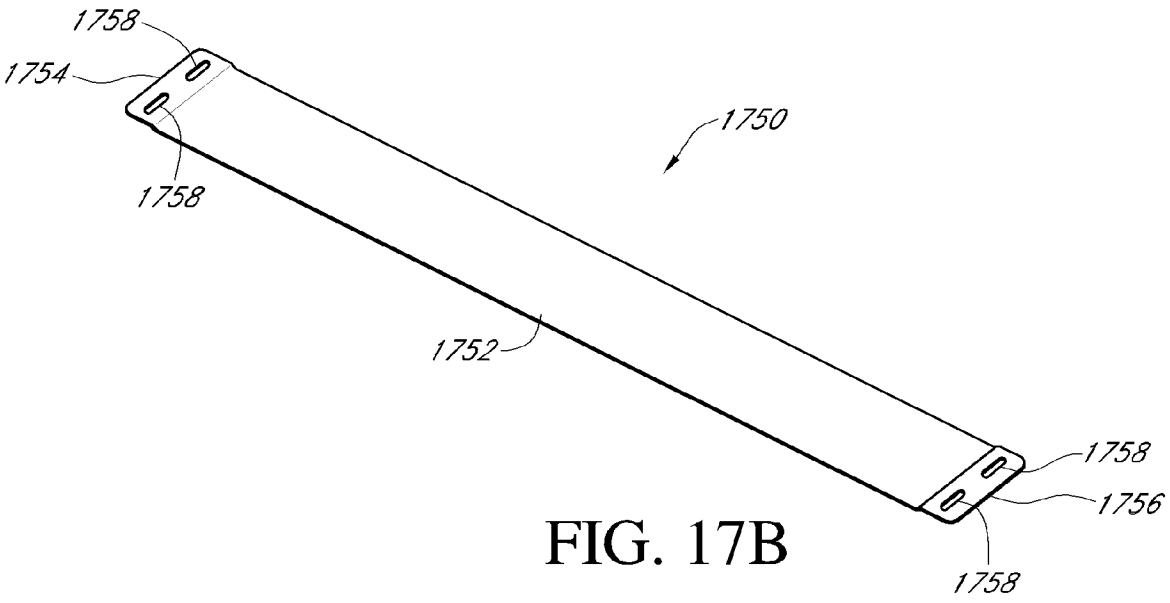
FIGS. 17A-17B illustrate brackets for use in some thermoelectric device embodiments.
Figure 17A:
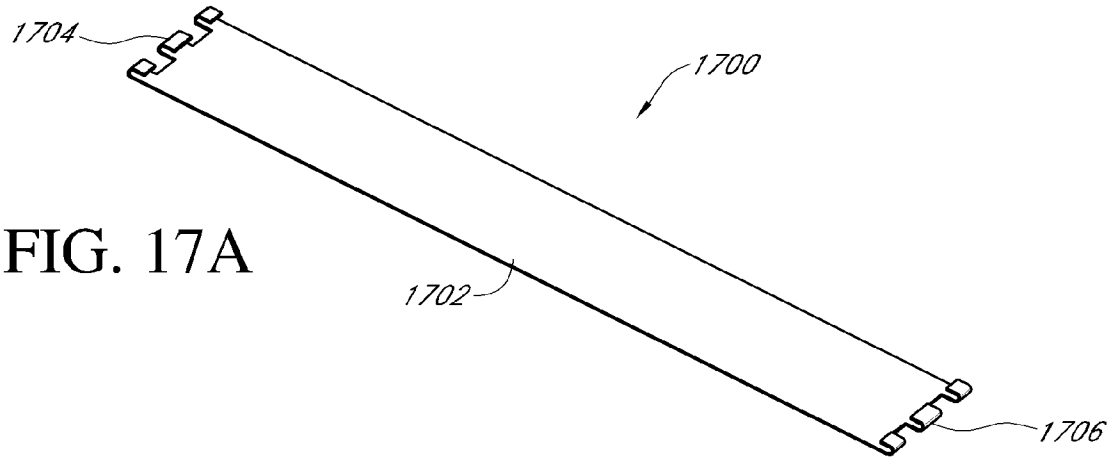

FIG. 17A illustrates a bracket 1700 having a base 1702 from which hooks 1704, 1706 extend on opposite ends of the base 1702. The hooks 1704, 1706 can be separated by gaps to allow matching clip hooks to be inserted therebetween. The bracket has a length proportional to the length of a row of TE modules which it is designed to secure. In some embodiments, the bracket 1700 includes a spring element (not shown), such as, for example, a dip or U-shaped feature positioned along the base 1702. The spring element allows the length of the bracket 1700 to extend a small distance to allow the bracket 1700 to tightly clamp TE module surfaces and fins together. Along with thermal interface material disposed in areas between module surfaces and fins, tight clamping can provide increased contact and thermal conductivity between TE module surfaces and the fins.

FIG. 17B illustrates a bracket 1750 having a base 1752 and raised portions 1754, 1756 at opposite ends of the base 1752. The raised portions 1754, 1756 can be positioned to allow a clip positioned beneath the raised portion to be substantially flush with the base 1752 of the bracket 1750 when the clip and bracket are used in a TE module row assembly. The raised portions 1754, 1756 have slots 1758 formed therein. The slots 1758 are configured to engage matching tabs extending from clips.

Figure 18:
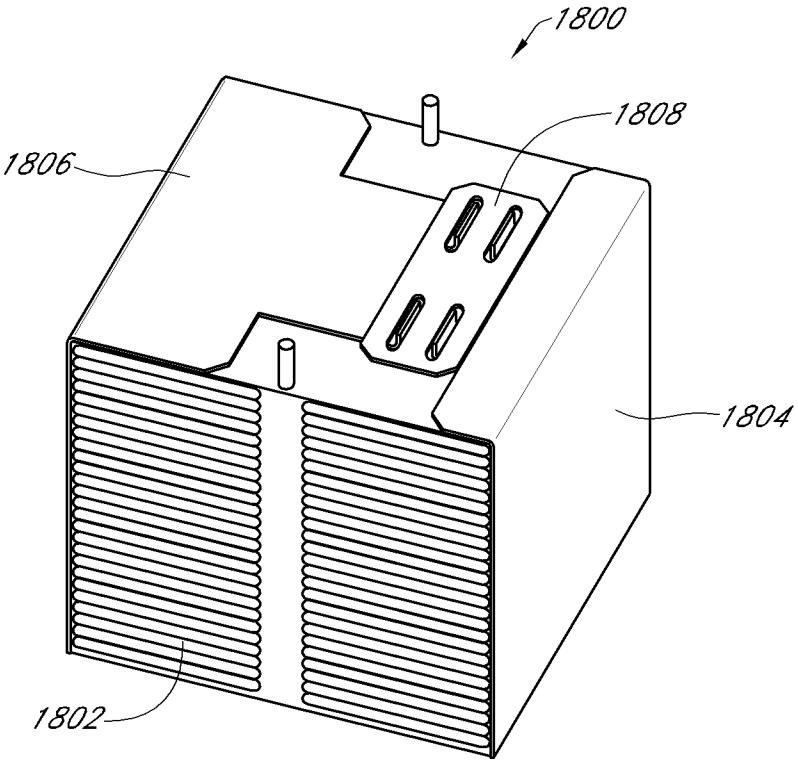
FIG. 18 illustrates a portion of a thermoelectric device.

FIG. 18 illustrates a row 1800 having a single TE module 1802. The TE module 1802 is secured on its respective ends by a first clip 1806 and a second clip 1804 having unequal-length legs. The clips 1804, 1806 are connected to one another by a bracket 1808. The bracket 1808 is sized to accommodate a row with only one TE module 1802.

Figure 19A:
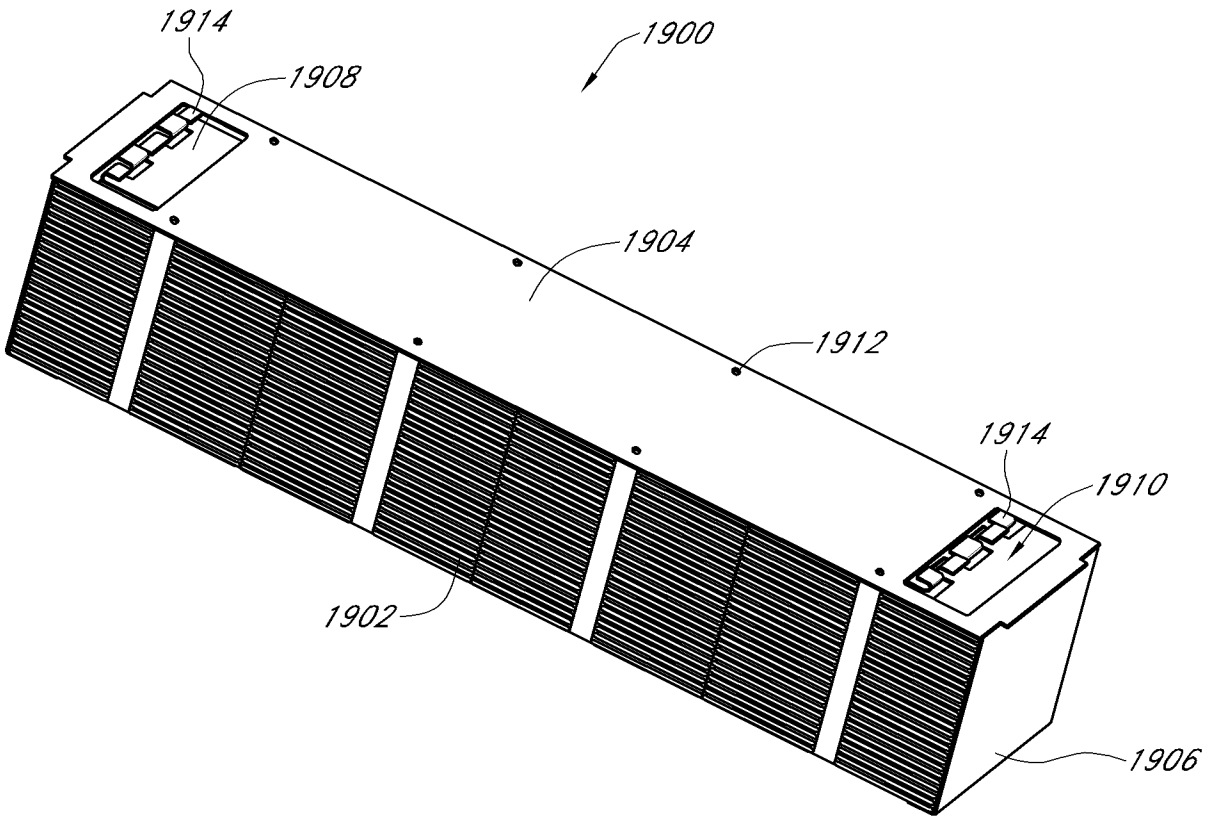
FIG. 19A-19B show configurations for a row of thermoelectric modules for use in some thermoelectric device embodiments.

FIG. 19A shows a row 1900 of TE modules 1902 secured together by clips 1906 and brackets 1908. A printed circuit board 1904 (PCB) is positioned alongside the row 1900 on top of a bracket 1908. In some embodiments, the PCB 1904 is configured to provide conductors that supply power to the TE modules 1902 in the row 1900. The PCB 1904 includes openings 1910 that provide clearance for connecting hooks 1914 that extend into the plane of the PCB 1904. The PCB 1904 also includes apertures 1912 that provide clearance for TE module 1902 power terminals.

Figure 19B:
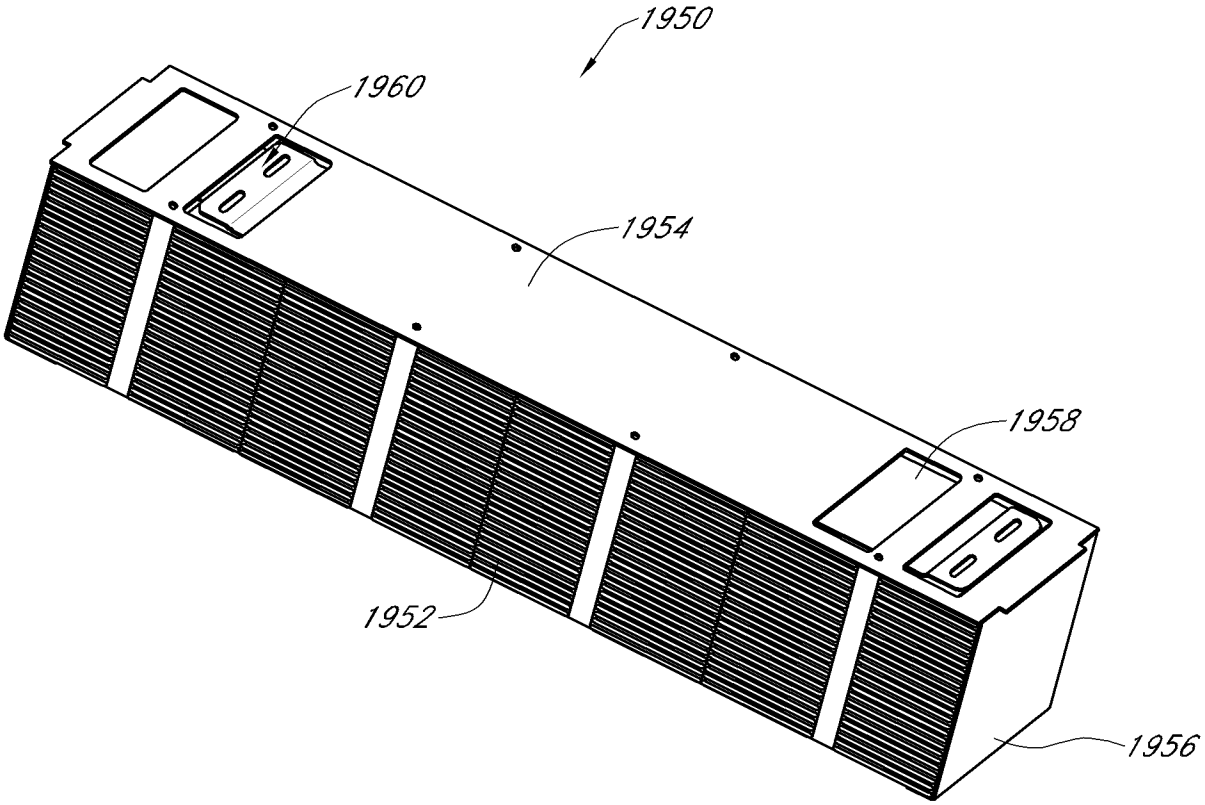

FIG. 19B shows a row 1950 of TE modules 1952 secured together by clips 1956 and brackets 1958. A PCB 1954 disposed on top of a bracket 1958 includes openings 1960 that provide clearance for tabs and slot portions of the bracket 1958 that extend into the plane of the PCB 1954.

Figure 20:
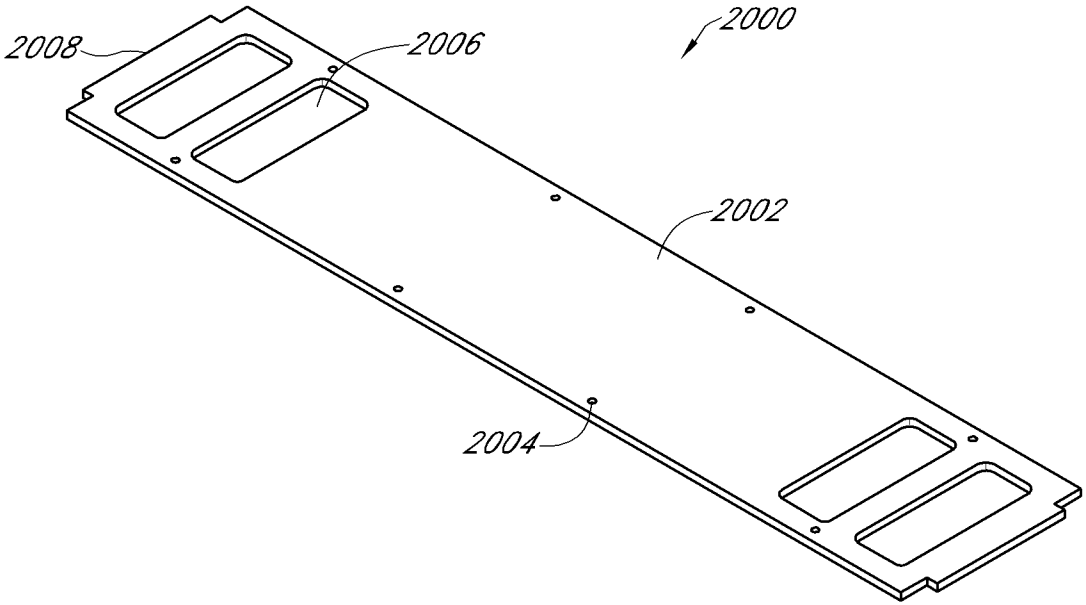
FIG. 20 illustrates a conductor positioning apparatus for use in some thermoelectric device embodiments.

FIG. 20 shows a top side of a PCB 2000 that includes certain features for operatively connecting to a row of TE modules. The PCB 2000 includes a body portion 2002 that has apertures 2004 formed therein. The apertures 2004 are positioned to approximately align with TE module power terminals when the PCB 2000 is positioned alongside a row of TE modules. The apertures provide spaces for module wiring. Apertures at the ends of the PCB 2000 can provide spaces for lead wires from an array power supply. The PCB 2000 includes openings 2006 configured to accommodate protrusions from the underlying TE module row assembly. Examples of protrusions include connecting hooks and/or tabs. The PCB 2000 can also include row tabs 2008 disposed at ends of the PCB 2000. The row tabs 2008 can be configured to engage side pieces that register rows (for example, providing regular row spacing) with respect to one another.

Figure 21:
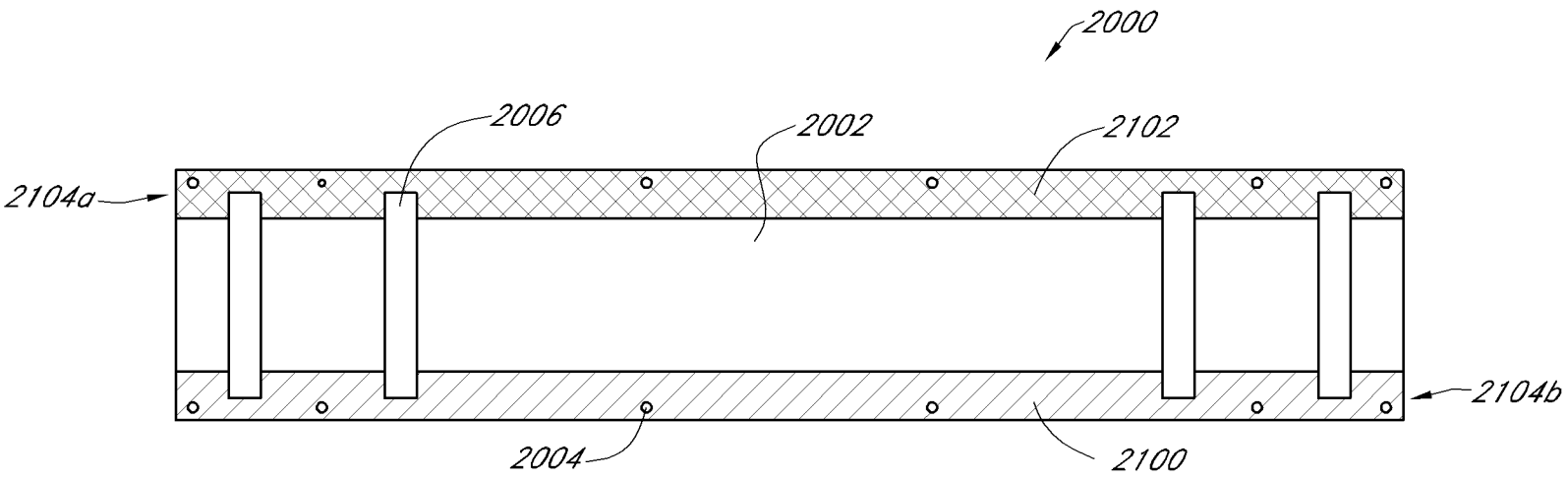
FIG. 21 illustrates a conductor positioning apparatus for use in some thermoelectric device embodiments.

FIG. 21 shows a bottom side of the PCB 2000 shown in FIG. 20. The PCB 2000 includes a first trace 2100 and a second trace 2102 disposed along sides of the PCB 2000. The traces can be wide enough to solder flat wires at ends 2104 of the PCB 2000 for electrically connecting rows of modules together. Solder dams can be made in the traces around apertures 2004 in the PCB to facility soldering. In some embodiments, the traces 2100, 2102 are made from copper. Any suitable amount of conductor material can be used, such as, for example, about two ounces of copper. In some embodiments, the PCB 2000 is single-sided (for example, the PCB has traces on only one side) and has no plated-through holes. In other embodiments, the PCB 2000 is double-sided and includes plated-through holes. In some embodiments, the number of PCBs 2000 and rows of TE modules is equal. In other embodiments, there are two separate PCBs 2000 for each row of TE modules (for example, there can be two PCBs stacked between adjacent rows of modules).

Figure 22:
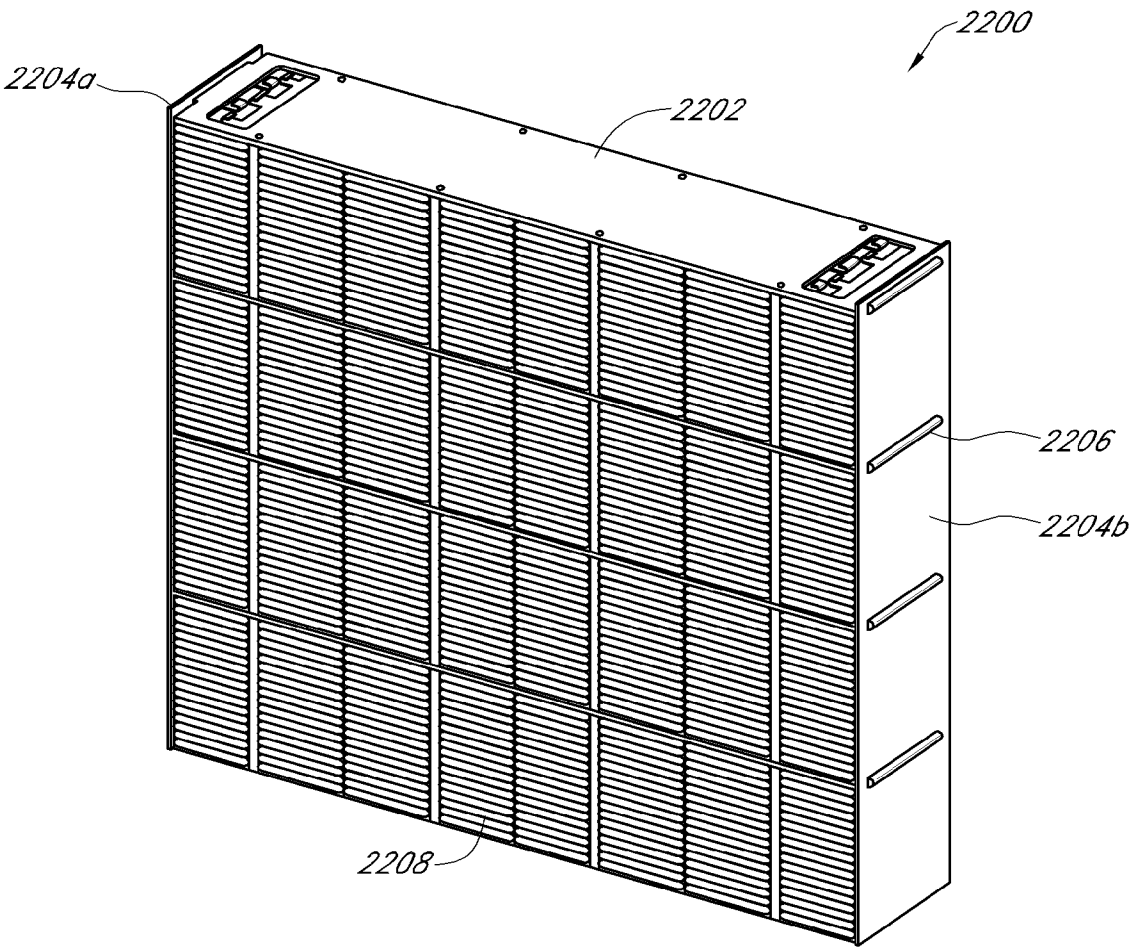
FIG. 22 illustrates an array of thermoelectric modules for use in some thermoelectric device embodiments.

FIG. 22 illustrates an array 2200 of TE modules 2208 with wired rows stacked on top of one another. The array 2200 includes PCBs 2202 disposed between stacked rows of modules 2208 and can also include a PCB disposed alongside the top row and/or bottom row of modules. Side members 2204 can be operatively connected to keep the rows within the array registered. The side members 2204 can include slots with which row tabs 2206 engage. In the illustrated embodiment, the row tabs 2206 extend from the PCBs 2202 positioned within the array 2200. At least some of the PCBs 2202 can include conductive traces to facilitate wiring (not shown) within the array. In some embodiments, the side members 2204 are constructed from rigid plastic, printed circuit board material, or another suitable material. In certain embodiments, an outer edge of the row tabs 2206 is flush with an outer surface of the side member 2204.

Figure 24:
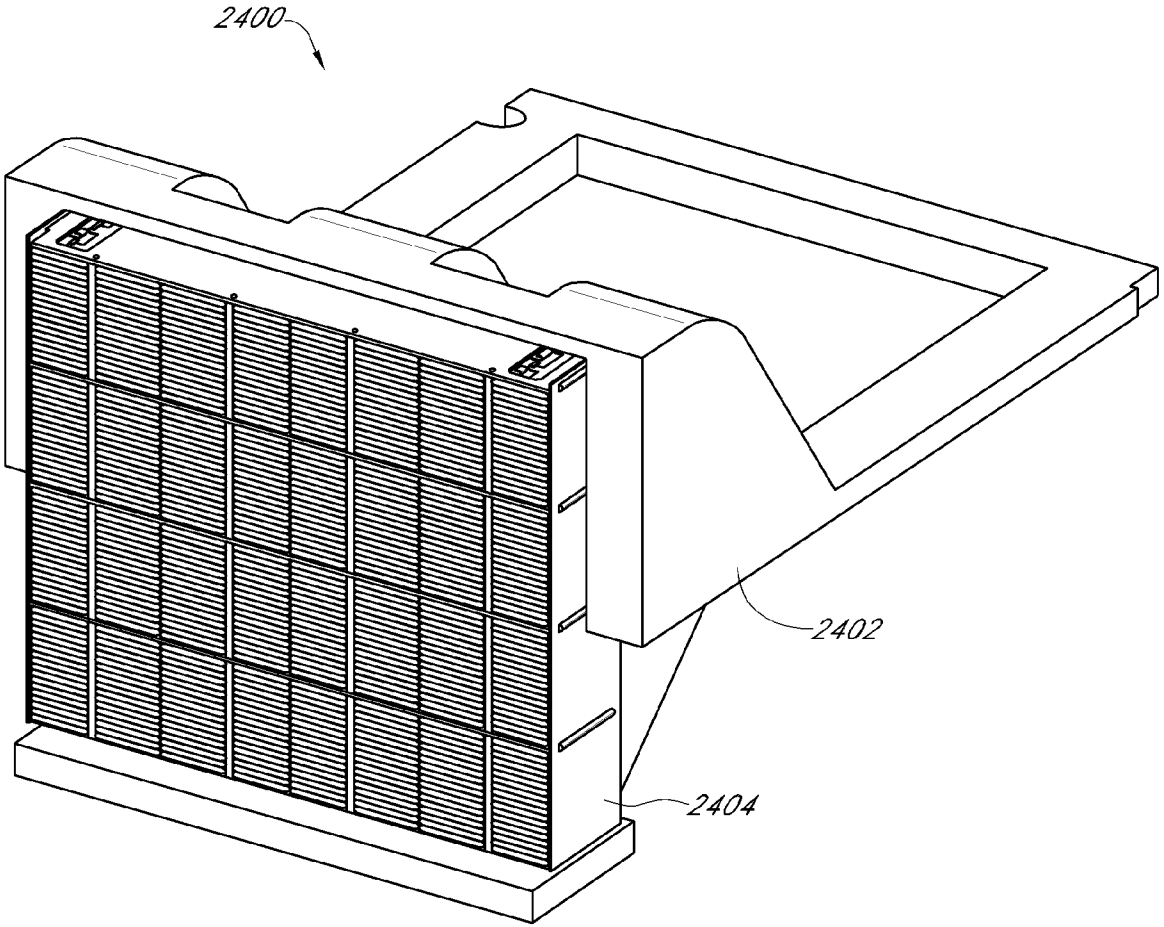
FIG. 24 shows an array of thermoelectric modules installed in a fluid channeling enclosure.

FIG. 24 shows a perspective view of portions of a TE device assembly 2400 that includes an array 2404 of TE modules positioned in a channel enclosure 2402 (for example, an air guide). The channel enclosure 2402 is configured to route fluid through the array 2404 and keep main fluid flows separate from waste fluid flows.

Although the invention has been described in terms of particular embodiments, many variations will be apparent to those skilled in the art. All such variations are intended to be included within the scope of the disclosed invention and the appended claims.

What is claimed is:

1. An assembly for a thermoelectric heat pump comprising:

an enclosure enclosing a plurality of physically isolated fluid channels;

a contiguous single waste fluid inlet configured to accept a waste stream when the thermoelectric heat pump operates and to direct the waste stream into the enclosure;

a waste stream divider assembly inside of the enclosure and configured to divide the waste stream and to direct the waste stream into a plurality of waste fluid channels;

a contiguous single main fluid inlet configured to accept a main stream when the thermoelectric heat pump operates and to direct the main stream into the enclosure;

a main stream divider assembly inside of the enclosure and configured to divide the main stream and to direct the main stream into a plurality of main fluid channels;

a heat transfer region comprising a first thermoelectric module operatively connected to the enclosure, the first thermoelectric module comprising a main junction and a waste junction;

an elongate heat transfer member extending from at least one of the main junction and the waste junction of the first thermoelectric module into at least one of the plurality of physically isolated fluid channels;

at least one gap dividing the elongate heat transfer member into a plurality of heat transfer sections that are at least partially thermally isolated from adjacent heat transfer sections by the at least one gap, the at least one gap oriented such that fluid flows across the at least one gap as fluid flows through the at least one of the plurality of physically isolated fluid channels of the thermoelectric heat pump; and at least one bridge member extending across the at least one gap, the at least one bridge member connecting at least one of the plurality of heat transfer sections to a second heat transfer section;

wherein the waste stream has a first flow pattern from the contiguous single waste fluid inlet through the plurality of waste fluid channels, and wherein the main stream has a second flow pattern from the contiguous single main fluid inlet through the plurality of main fluid channels, and wherein the first flow pattern and the second flow pattern create a fluid flow system with counter flow through a stacked array of thermoelectric modules within the heat transfer region when the thermoelectric heat pump operates.

2. The assembly of claim 1, further comprising a second thermoelectric module operatively connected to the enclosure, the second thermoelectric module having a second main junction and a second waste junction.

3. The assembly of claim 2, wherein the first thermoelectric module and the second thermoelectric module are arranged in parallel planes, and wherein the first and second thermoelectric modules are oriented such that the waste junction of the first thermoelectric module and the second waste junction of the second thermoelectric module face towards one another.

4. The assembly of claim 2, wherein the elongate heat transfer member extends from the waste junction of the first thermoelectric module to the second waste junction of the second thermoelectric module.

5. The assembly of claim 2, wherein the elongate heat transfer member extends about half the distance from the waste junction of the first thermoelectric module to the second waste junction of the second thermoelectric module.

6. The assembly of claim 1, wherein the at least one bridge member is formed by removing portions of the elongate heat transfer member.

7. The assembly of claim 1, further comprising at least a second bridge member connecting the second heat transfer section to a third heat transfer section, wherein the at least one bridge member and the second bridge member are disposed at staggered positions along the at least one gap and at least a second gap.

8. The assembly of claim 1:

wherein the heat transfer region comprises a plurality of rows, each of the plurality of rows comprising a plurality of thermoelectric modules;

wherein the waste fluid channels are configured to be in substantial thermal communication with a high temperature portion of the heat transfer region;

wherein the main fluid channels are configured to be in substantial thermal communication with a low temperature portion of the heat transfer region;

and wherein the main stream divider assembly and the waste stream divider assembly provide a barrier between fluid in the plurality of waste fluid channels and fluid in the plurality of main fluid channels.

9. The assembly of claim 8, wherein the waste fluid channels and the main fluid channels are positioned and shaped such that differences in temperature between fluids disposed near opposite sides of the channel enclosure are substantially minimized at corresponding positions along the main fluid channels and the waste fluid channels.

10. The assembly of claim 1, further comprising a support member extending across the plurality of physically isolated fluid channels in a direction substantially parallel to the elongate heat transfer member, the support member comprising a curved base portion configured to clamp together the stacked array of thermoelectric modules and one or more elongate heat transfer members when the support member is attached to the heat transfer region.

11. The assembly of claim 10, wherein the curved base portion is configured to generate a compressive force on the stacked array of thermoelectric modules and one or more elongate heat transfer members.

12. The assembly of claim 10, wherein the curved base portion has a parabolic shape.

13. The assembly of claim 10, wherein the curved base portion comprises a dip or U-shaped feature.

14. A method of manufacturing a thermoelectric heat pump, the method comprising:

providing an enclosure enclosing a plurality of physically isolated fluid channels formed inside of the enclosure;

connecting a waste stream divider assembly inside of the enclosure, wherein the waste stream divider assembly is configured to divide a waste stream received through a contiguous waste fluid inlet and to direct the waste stream into a plurality of waste fluid channels;

connecting a main stream divider assembly inside of the enclosure, wherein the main stream divider assembly is configured to divide a main stream received through a contiguous main fluid inlet and to direct the main stream into a plurality of main fluid channels;

operatively connecting a heat transfer region comprising a first thermoelectric module to the enclosure, the first thermoelectric module comprising a main junction and a waste junction;

connecting the heat transfer region to the waste stream divider assembly and to the main stream divider assembly, wherein the waste stream has a first flow pattern from the contiguous single waste fluid inlet through the plurality of waste fluid channels, and wherein the main stream has a second flow pattern from the contiguous single main fluid inlet through the plurality of main fluid channels, and wherein the first flow pattern and the second flow pattern create a fluid flow system with counter flow through a stacked array of thermoelectric modules within the heat transfer region when the thermoelectric heat pump operates;

disposing an elongate heat transfer member within the enclosure, the elongate heat transfer member extending from at least one of the main junction and the waste junction of the first thermoelectric module into at least one of the plurality of physically isolated fluid channels;

providing at least one gap in the elongate heat transfer member, the at least one gap dividing the elongate heat transfer member into a plurality of heat transfer sections that are at least partially thermally isolated from adjacent heat transfer sections by the at least one gap, the at least one gap oriented such that fluid flows across the at least one gap as fluid flows through the at least one of the plurality of fluid channels of the thermoelectric heat pump; and disposing at least one bridge member across the at least one gap, the at least one bridge member connecting at least one of the plurality of heat transfer sections to a second heat transfer section.

15. The method of claim 14, further comprising operatively connecting a second thermoelectric module operatively connected to the enclosure, the second thermoelectric module having a second main junction and a second waste junction.

16. The method of claim 15, further comprising:

arranging the first thermoelectric module and the second thermoelectric module in parallel planes; and orienting the first and second thermoelectric modules such that the waste junction of the first thermoelectric module and the second waste junction of the second thermoelectric module face towards one another.

17. The method of claim 15, further comprising disposing the elongate heat transfer member between the waste junction of the first thermoelectric module and the second waste junction of the second thermoelectric module.

18. The method of claim 15, further comprising disposing the elongate heat transfer member such that the elongate heat transfer member extends about half the distance from the waste junction of the first thermoelectric module to the second waste junction of the second thermoelectric module.

19. The method of claim 14, further comprising forming the at least one bridge member by removing portions of the elongate heat transfer member.

20. The method of claim 14, wherein the at least one bridge member joins a plurality of separate heat transfer sections to form an elongate heat transfer member.

21. The method of claim 14, further comprising disposing at least a second bridge member between the second heat transfer section and a third heat transfer section, wherein the at least one bridge member and the second bridge member are disposed at staggered positions along the at least one gap and at least a second gap.

22. A method of operating a thermoelectric heat pump having an enclosure enclosing a plurality of physically isolated fluid channels and a heat transfer region comprising a stacked array of thermoelectric modules, the method comprising:

receiving a waste stream into the enclosure through a contiguous waste fluid inlet;

dividing the waste stream received through the contiguous waste fluid inlet and directing the waste stream into a plurality of waste fluid channels, wherein the plurality of waste fluid channels are connected to a plurality of waste heat transfer passageways disposed within the heat transfer region, and wherein the plurality of waste heat transfer passageways comprise heat exchangers in thermal communication with waste surfaces of thermoelectric modules in the heat transfer region;

directing the waste stream through the waste heat transfer passageways, wherein the waste stream flows through the waste heat transfer passageways in a first flow pattern;

receiving a main stream into the enclosure through a contiguous main fluid inlet;

dividing the main stream received through the contiguous main fluid inlet and directing the main stream into a plurality of main fluid channels, wherein the plurality of main fluid channels are connected to a plurality of main heat transfer passageways disposed within the heat transfer region, and wherein the plurality of main heat transfer passageways comprise heat exchangers in thermal communication with main surfaces of thermoelectric modules in the heat transfer region;

directing the main stream through the main heat transfer passageways, wherein the main stream flows through the main heat transfer passageways in a second flow pattern, and wherein the first flow pattern and the second flow pattern create a fluid flow system with counter flow through the heat transfer region; and transferring heat between the waste stream and the main stream in the heat transfer region using the stacked array of thermoelectric modules.

* * * * *